US011825883B2

(12) United States Patent
Rado

(10) Patent No.: US 11,825,883 B2
(45) Date of Patent: Nov. 28, 2023

(54) PERSONAL VAPORIZER

(71) Applicant: Lubby Holdings, LLC, Torrance, CA (US)

(72) Inventor: J. Christian Rado, Torrance, CA (US)

(73) Assignee: Lubby Holdings, LLC, Torrance, CA (US)

( * ) Notice: Subject to any disclaimer, the term of this patent is extended or adjusted under 35 U.S.C. 154(b) by 0 days.

(21) Appl. No.: 16/513,701

(22) Filed: Jul. 16, 2019

(65) Prior Publication Data

US 2020/0015524 A1 Jan. 16, 2020

Related U.S. Application Data

(60) Provisional application No. 62/698,635, filed on Jul. 16, 2018.

(51) Int. Cl.
*A24F 7/00* (2006.01)
*H05B 1/02* (2006.01)

(52) U.S. Cl.
CPC ..... *A24F 7/00* (2013.01); *H05B 1/0297* (2013.01)

(58) Field of Classification Search
CPC ..... A24F 47/00; A24F 40/57; A34F 40/46
See application file for complete search history.

(56) References Cited

U.S. PATENT DOCUMENTS

| | | | |
|---|---|---|---|
| 2,104,266 | A | 1/1938 | McCormick |
| 3,200,819 | A | 8/1965 | Gilbert |
| 3,788,330 | A | 1/1974 | Griffith |
| 4,292,983 | A | 10/1981 | Mensik |
| 4,947,874 | A | 8/1990 | Brooks |
| 6,532,965 | B1 | 3/2003 | Abhulimen |
| 6,543,448 | B1 | 4/2003 | Smith |
| 7,832,410 | B2 | 11/2010 | Hon |
| 7,997,280 | B2 | 8/2011 | Rosenthal |
| 8,156,944 | B2 | 4/2012 | Han |
| 8,365,742 | B2 | 2/2013 | Hon |
| 8,375,957 | B2 | 2/2013 | Hon |
| 8,528,569 | B1 | 9/2013 | Newton |
| 8,794,231 | B2 | 8/2014 | Thorens |

(Continued)

FOREIGN PATENT DOCUMENTS

| | | |
|---|---|---|
| WO | WO2014102095 | 7/2014 |
| WO | WO2019/057939 | 3/2019 |

OTHER PUBLICATIONS

International Search Report from USPTO dated Dec. 6, 2019 for related International Application No. PCT/US2019/042099.

(Continued)

*Primary Examiner* — Kelly M Gambetta
*Assistant Examiner* — Katherine A Will
(74) *Attorney, Agent, or Firm* — KOS IP Law LLP

(57) ABSTRACT

A personal vaporizer is configured to be used with a battery assembly. An atomizer of the personal vaporizer is configured to atomize vaporizing media, which atomized media becomes entrained in air flowing through the vaporization chamber to form a vapor. The personal vaporizer can include a warming element that warms vaporizing media within the tank without atomizing such media in order to reduce the viscosity of such media and improve media flow within the tank. The warming element can be passive or electrically powered.

17 Claims, 18 Drawing Sheets

(56) References Cited

U.S. PATENT DOCUMENTS

| | | | | |
|---|---|---|---|---|
| 8,899,238 | B2 | 12/2014 | Robinson | |
| 8,915,254 | B2 | 12/2014 | Monsees | |
| 8,925,555 | B2 | 1/2015 | Monsees | |
| 9,220,303 | B2 | 12/2015 | Li | |
| 9,380,811 | B2 | 7/2016 | Chung | |
| 9,456,632 | B2 | 10/2016 | Hon | |
| 9,462,832 | B2 | 10/2016 | Lord | |
| 9,491,974 | B2 | 11/2016 | DePiano | |
| 9,578,898 | B2 * | 2/2017 | Liu | A24F 40/46 |
| 9,750,284 | B2 | 9/2017 | Rado | |
| 10,004,264 | B2 | 6/2018 | Rado | |
| 10,021,909 | B2 | 7/2018 | Rado | |
| 10,085,481 | B2 | 10/2018 | Verleur | |
| 10,188,145 | B2 | 1/2019 | Rado | |
| 10,219,541 | B2 | 3/2019 | Rado | |
| 10,244,792 | B2 | 4/2019 | Rado | |
| 10,321,721 | B2 | 6/2019 | Rado | |
| 10,327,470 | B2 | 6/2019 | Rado | |
| 2009/0293888 | A1 | 12/2009 | Williams | |
| 2010/0147292 | A1 | 6/2010 | Hamaguchi | |
| 2011/0061649 | A1 | 3/2011 | Hirshberg | |
| 2011/0094523 | A1 | 4/2011 | Thorens | |
| 2013/0152922 | A1 | 6/2013 | Benassayag | |
| 2013/0192615 | A1 | 8/2013 | Tucker | |
| 2013/0247910 | A1 | 9/2013 | Postma | |
| 2013/0306065 | A1 | 11/2013 | Thorens | |
| 2014/0000638 | A1 * | 1/2014 | Sebastian | A24F 47/008 131/328 |
| 2014/0041655 | A1 | 2/2014 | Barron | |
| 2014/0123989 | A1 | 5/2014 | LaMothe | |
| 2014/0202477 | A1 | 7/2014 | Qi | |
| 2014/0261488 | A1 * | 9/2014 | Tucker | A24F 47/008 131/328 |
| 2015/0144148 | A1 | 5/2015 | Chen | |
| 2015/0208729 | A1 | 7/2015 | Monsees | |
| 2015/0208730 | A1 | 7/2015 | Li | |
| 2015/0208731 | A1 | 7/2015 | Malamud | |
| 2015/0258288 | A1 | 9/2015 | Sullivan | |
| 2016/0095357 | A1 | 4/2016 | Burton | |
| 2016/0183596 | A1 | 6/2016 | Rado | |
| 2016/0360790 | A1 | 12/2016 | Calfee | |
| 2017/0027223 | A1 * | 2/2017 | Eksouzian | H05B 1/0227 |
| 2017/0027232 | A1 * | 2/2017 | Scheck | A24F 47/008 |
| 2017/0119059 | A1 * | 5/2017 | Zuber | A24F 47/008 |
| 2017/0135404 | A1 | 5/2017 | Reevell | |
| 2017/0354186 | A1 * | 12/2017 | Johnson | A61M 11/042 |
| 2018/0020726 | A1 * | 1/2018 | Alarcon | A24F 47/008 131/329 |
| 2018/0043115 | A1 * | 2/2018 | Gould | A61M 15/0021 |
| 2018/0177240 | A1 * | 6/2018 | Duque | H05B 3/06 |
| 2019/0021395 | A1 * | 1/2019 | Qiu | A24F 47/008 |
| 2019/0022345 | A1 * | 1/2019 | Kotch | A24F 40/42 |

OTHER PUBLICATIONS

Written Opinion from USPTO dated Dec. 6, 2019 for related International Application No. PCT/US2019/042099.

* cited by examiner

PERSONAL VAPORIZER

CROSS-REFERENCE TO RELATED APPLICATIONS

This application claims priority from U.S. Provisional Application No. 62/698,635, which was filed on Jul. 16, 2018, the entirety of which is hereby incorporated by reference.

BACKGROUND

The present disclosure relates to the field of personal vaporizers.

Personal vaporizers are handheld devices that vaporize a vaporizing medium such as an essential oil-based fluid or electronic cigarette fluid (e-liquid). The vapor is then inhaled by its user. A typical personal vaporizer has an atomizer having a heating element that selectively heats the medium in order to produce the vapor. A rechargeable battery is also typically employed for powering the atomizer.

Personal vaporizers for vaporizing fluid media typically include a fluid chamber, or tank, that holds the fluid, and a wick that communicates fluid from the tank to the atomizer. Sometimes the heating element is incorporated into the wick. Electronic cigarettes are a type of personal vaporizer, and use a liquid solution that typically includes tobacco-derived nicotine. The fluid solution for e-liquids typically includes chemicals such as one or more of propylene glycol, glycerin, polyethylene glycol 400, and an alcohol. Extracted flavorings can also be included in the fluid. Personal vaporizers also can be used with fluid solutions that include—or are even substantially made up entirely of—one or more of various essential oils, including cannabis- or hemp-derived oils.

Some types of vaporizing media have a high viscosity, and are susceptible to low flow. If the media is atomized faster than it can flow to a vaporization chamber, vapor generation can suffer. Also, management of air flow through the personal vaporizer can have an important effect on vapor quality.

SUMMARY

There is a need in the art for a personal vaporizer that can accommodate high-viscosity vaporizing media while maintaining a high quality vapor generation. There is also a need in the art for a personal vaporizer with advantageous airflow management.

In accordance with one embodiment the present specification provides a method for vaporizing a vaporizing media in which the media is warmed in a tank upstream of a vaporization chamber. The present specification also contemplates embodiments of personal vaporizers configured to warm vaporizing media in a tank upstream of a vaporization chamber.

In accordance with one embodiment, the present specification provides a personal vaporizer, comprising a tank configured to contain a volume of a vaporizing medium, a vaporization chamber, a heating element at or adjacent the vaporization chamber, the heating element configured to atomize vaporizing medium within the vaporization chamber when the heating element is actuated, and a passive warming element configured to capture a portion of the heat generated by the heating element and communicate at least a portion of the captured heat to the vaporizing medium still within the tank. The amount of heat communicated from the passive warming element to the vaporizing medium is sufficient to reduce a viscosity of the vaporizing medium but is insufficient to atomize the vaporizing medium.

In accordance with another embodiment, the present specification provides a personal vaporizer comprising a center section comprising an elongated inlet passage, and elongated outlet passage. A tank is sandwiched between the inlet and outlet passage. An inlet is formed through a wall of the center section and communicating with the inlet passage, the outlet passage communicating with a mouthpiece. A vaporization chamber is defined distal of the tank, the vaporization chamber comprising a wick and a heating element, the wick being in communication with the tank so that vaporizing media from the tank flows into the wick, the heating element configured to atomize vaporizing media from the wick when the heating element is actuated. A distal end of the inlet passage is configured to communicate intake air into the vaporization chamber. A distal end of the outlet passage configured to communicate vapor from the vaporization chamber to the mouthpiece.

In some such embodiments, an air guide extends distally through a proximal opening of the vaporization chamber, and the air guide directs intake air from the distal end of the inlet passage into the vaporization chamber.

In additional embodiments, an inlet side of the air guide faces the distal end of the inlet passage, and an outlet side of the air guide faces the distal end of the outlet passage.

In yet further embodiments, a fill hole is formed through a proximal wall of the tank, and the mouthpiece comprises a stopper configured to plug the fill hole when the mouthpiece is attached to a proximal end of the center section. The mouthpiece additionally comprises a mouthpiece passage having an outlet, and when the mouthpiece is attached to the proximal end of the center section, the outlet passage communicates with the mouthpiece passage.

In accordance with yet another embodiment, the present specification provides a personal vaporizer comprising a tank configured to contain a volume of a vaporizing medium, a vaporization chamber, and a battery mount distal of the vaporization chamber. The battery mount comprises a positive electrical pole and a negative electrical pole. A primary heating element at or adjacent the vaporization chamber, the primary heating element configured to atomize vaporizing medium within the vaporization chamber when the primary heating element is actuated. The primary heating element is interposed in a circuit between the positive and negative electrical pole. A secondary heating element is disposed at or adjacent the tank so as to communicate heat to vaporization medium in the tank when the secondary heating element is actuated, the secondary heating element interposed in a circuit between the positive and negative electrical pole. The amount of heat communicated from the secondary heating element to the vaporizing medium is sufficient to reduce a viscosity of the vaporizing medium but is insufficient to atomize the vaporizing medium.

In additional embodiments, the primary heating element and the secondary heating element are arranged electrically in series.

In yet additional embodiments the primary heating element and the secondary heating element are arranged electrically in parallel.

In still further embodiments the secondary heating element is spaced proximally from the primary heating element.

Yet further embodiments additionally comprise an electrical conditioning device configured to condition electric power delivery to the secondary heating element.

In accordance with a still further embodiment, the present specification provides a personal vaporizer comprising a tank configured to contain a volume of a vaporizing medium, a vaporization chamber, a battery mount distal of the vaporization chamber in which the battery mount comprising a positive electrical pole and a negative electrical pole, and a heating element at or adjacent the vaporization chamber. The heating element is configured to atomize vaporizing medium within the vaporization chamber when the primary heating element is actuated. The primary heating element is interposed in a circuit between the positive and negative electrical pole. A secondary powered element is disposed proximal of the heating element. The secondary powered element is interposed in a circuit between the positive and negative electrical pole.

DESCRIPTION

Figure 1:
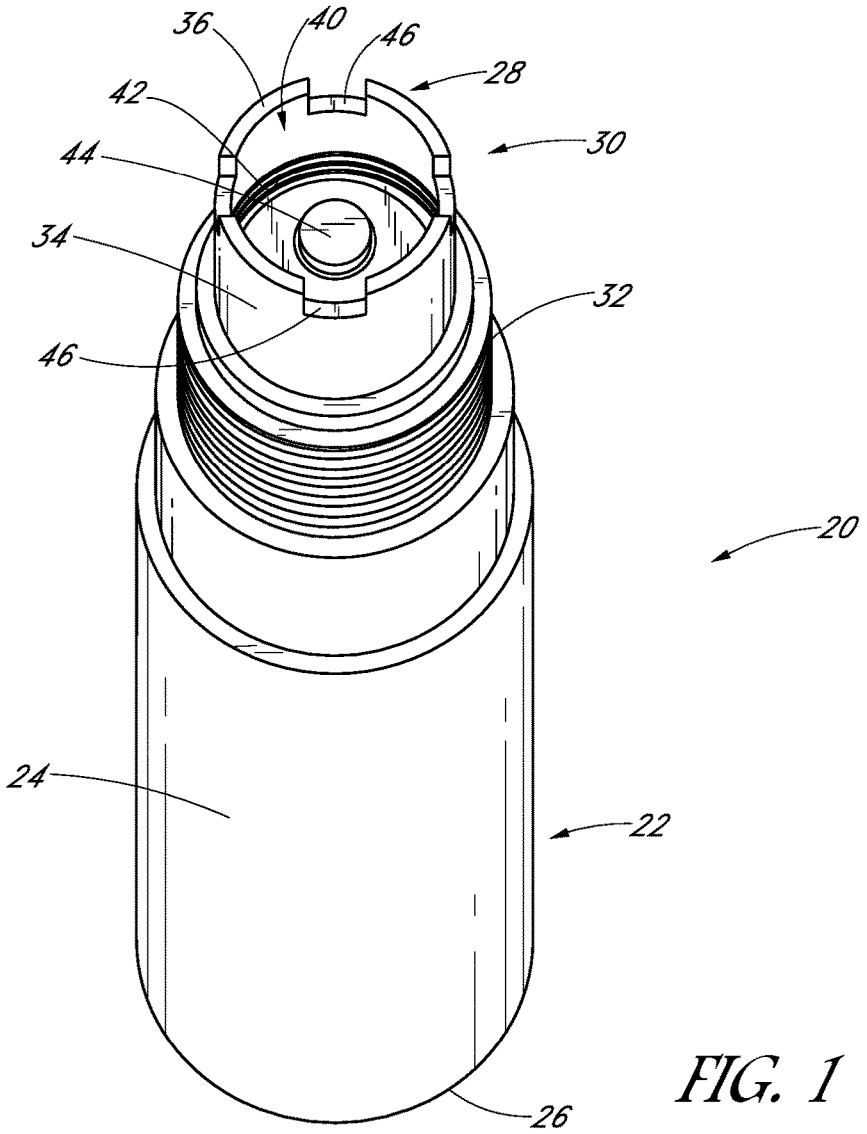
FIG. 1 is a perspective view of a battery assembly for use in some embodiments.
Figure 2:
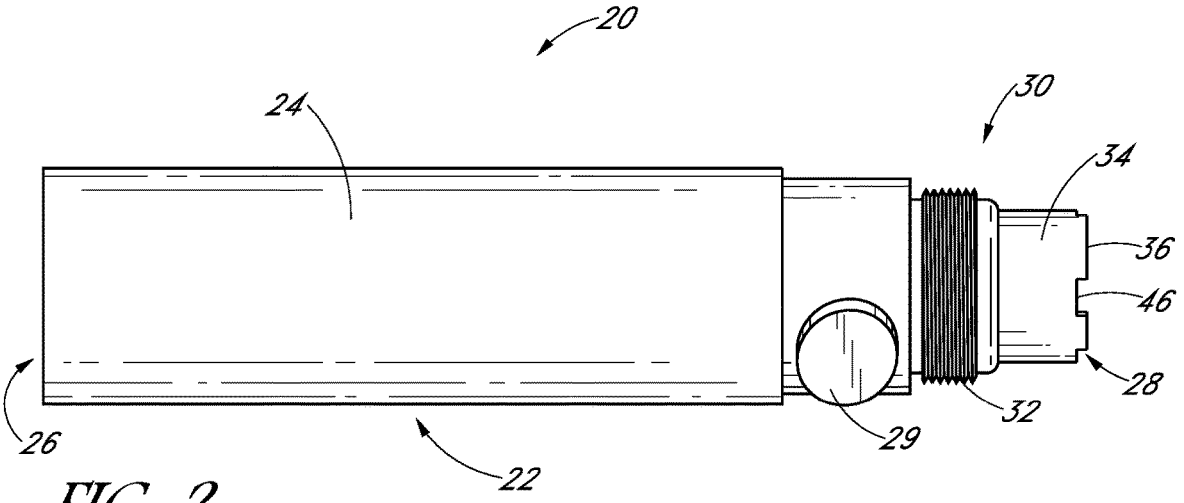
FIG. 2 is a side view of the battery assembly of FIG. 1.

With initial reference to FIGS. 1 and 2, an embodiment of a battery assembly 20, or battery pack, for a personal vaporizer is illustrated. Certain features of the illustrated battery assembly 20 are typical of battery assemblies currently available on the market. For example, the battery assembly 20 may include a rechargeable battery, such as a lithium-ion battery, enclosed within a battery casing 22. The battery casing 22 may include an elongated body 24 that extends from a base or distal end 26 to a top or proximal end 28. An electronic controller may also be included within the casing 22 to control voltage, current, timing and the like. A button 29 may be provided for selectively actuating electricity delivery from the battery 20 to the atomizer. In some embodiments, the button 29 can include a light that indicates when power is being delivered.

With continued reference to FIGS. 1 and 2, at and adjacent the proximal end 28 of the battery assembly 20, the battery casing 22 defines a mount boss 30. The mount boss 30 includes connecting structures for connecting vaporizing structures, such as atomizers and fluid chambers, to the battery. The elongated body 24 is disposed distally of the mount boss 30.

In the illustrated embodiment, the battery assembly mount boss 30 comprises an externally threaded portion 32 adjacent the body 24. Preferably, the externally threaded portion 32 has a diameter somewhat smaller than a diameter of the body 24. An extension 34 extends in a proximal direction from the externally threaded portion 32, preferably terminating in a top or proximal surface 36. As best shown in FIG. 2, the extension 34 preferably is tubular, defining a mount cavity 40 therewithin and having internal threads 42. Preferably, a diameter of the tubular extension 34 is less than the diameter of the externally threaded portion 32. A battery contact 44 is disposed within the tubular extension 34 at the base of the mount cavity 40. As shown, preferably a plurality of air intake slots 46 are formed in the extension at and adjacent the top surface.

A personal vaporizer is attachable to the battery mount boss 30. Such personal vaporizers typically include an atomizer and a fluid chamber, which can be provided as separate pieces or combined as a single structure. The personal vaporizer can be any of various styles, sizes, and configurations. For example, in some embodiments, the atomizer and fluid chamber are provided as one prefabricated cartridge which, in some embodiments, can be disposable. In some embodiments, the fluid chamber is refillable so that the cartridges are reusable. In other embodiments, the atomizer and fluid chamber are separately formed and selectively attachable and detachable from one another.

Personal vaporizers can also be attached to the battery assembly 20 in various ways. In some embodiments, an atomizer can threadingly engage the external threads 32 of the battery mount boss 30. In other embodiments, an atomizer may threadingly engage the internal threads 42 of the mount cavity extension 40. Preferably, a pin or other elongated contact extends into the mount cavity 40 to engage the battery contact 44 so as to communicate power from the battery 20 to the atomizer. Additional embodiments can employ non-threaded connection structures such as detents, friction fits, J-locks, and the like.

Applicant's U.S. Pat. No. 10,244,792 (the '792 patent) and U.S. Pat. No. 10,188,145 (the '145 patent) each describe embodiments of personal vaporizers that can be used in conjunction with a battery assembly as discussed above, and describe attributes and structure of personal vaporizers that may be incorporated into embodiments employing inventive aspects described in this specification. The entirety of each of the '792 patent and '145 patent is hereby incorporated by reference.

Figure 3:
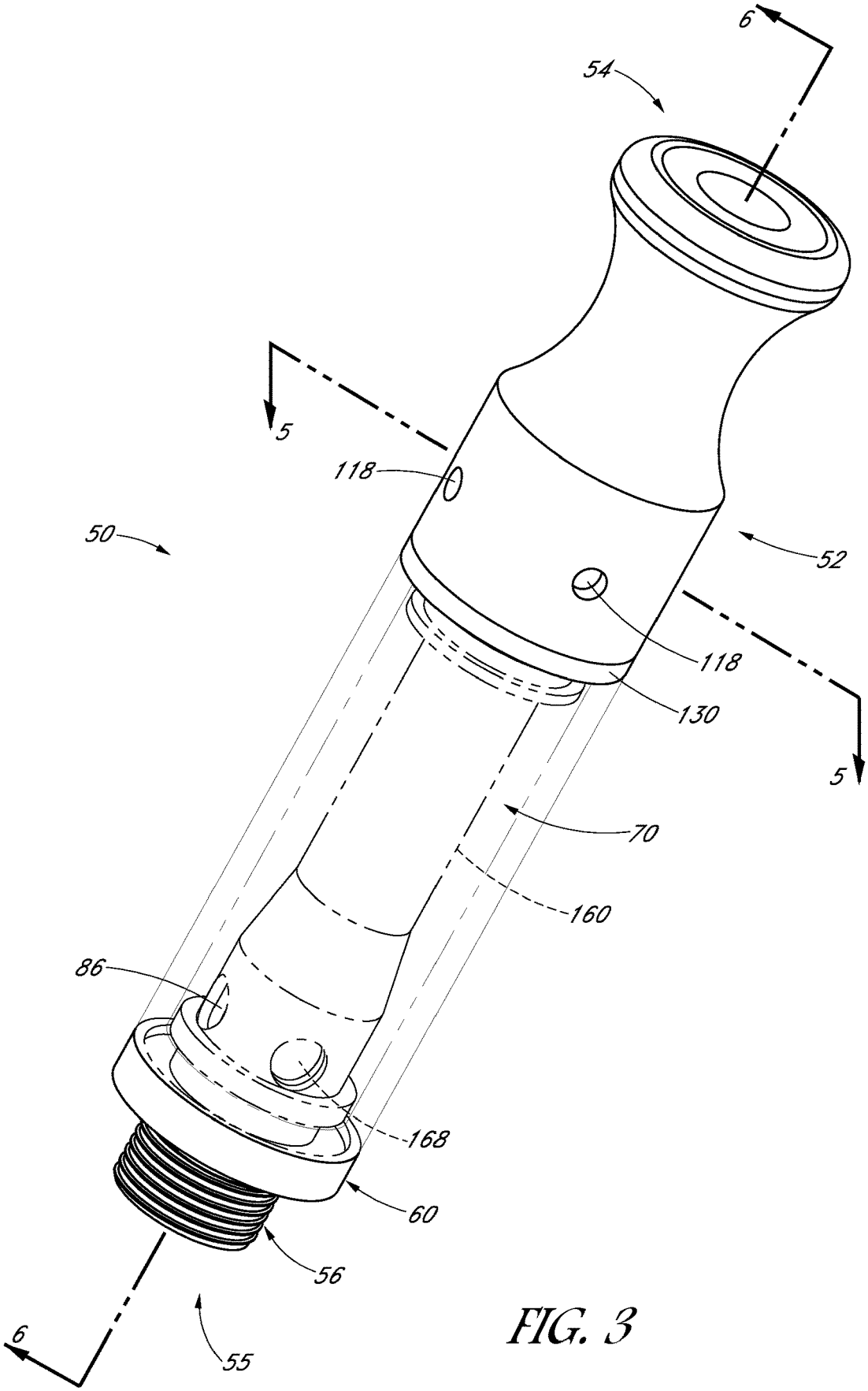
FIG. 3 is a perspective view of an embodiment of a personal vaporizer for use with the battery assembly of FIG. 1.
Figure 4:
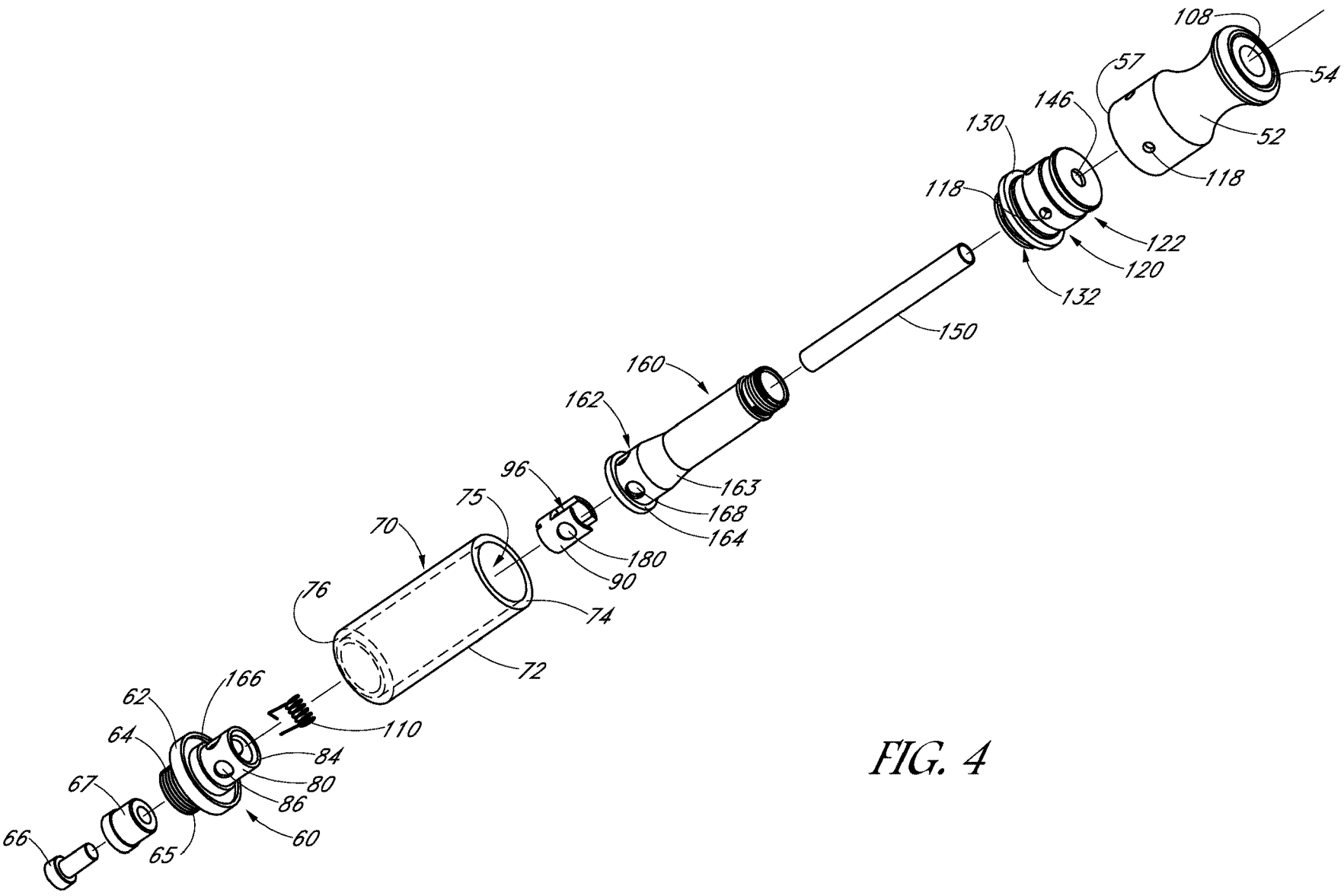
FIG. 4 is an exploded view of the personal vaporizer of FIG. 3.
Figure 5:
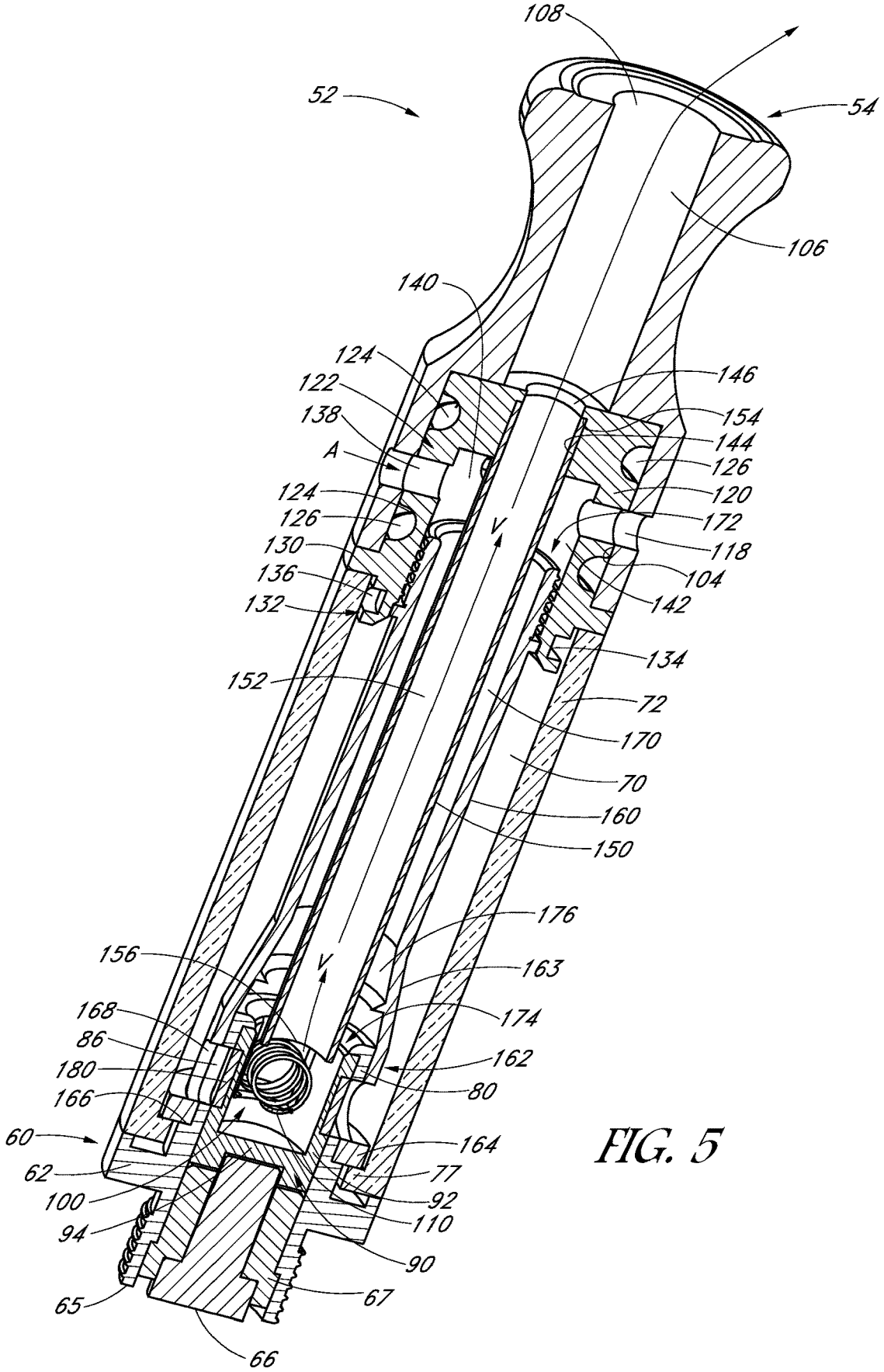
FIG. 5 is a cross-sectional view taken along lines 5-5 of FIG. 3.
Figure 6:
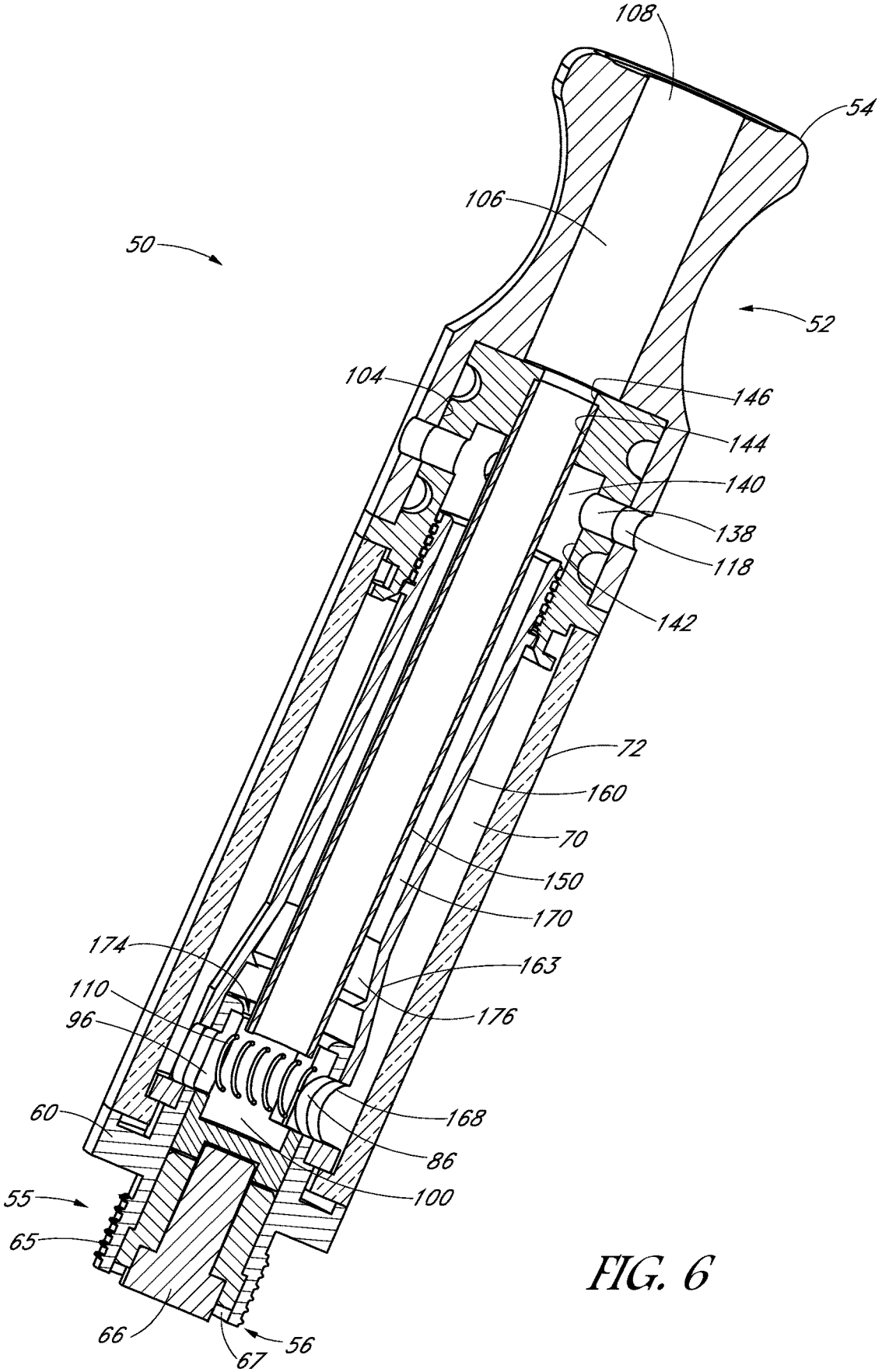
FIG. 6 is a cross-sectional view taken along lines 6-6 of FIG. 3.

With reference next to FIG. 3, an embodiment of a personal vaporizer 50 is shown. The illustrated personal vaporizer 50 can be attached to a battery assembly 20. In this embodiment, the personal vaporizer 50 has a mouthpiece 52 at its upper, or proximal, end 54, and a battery mount 55 at its bottom, or distal, end 56. The battery mount 55 is formed as part of a base 60. An elongated tank 70 is disposed between the base 60 and the mouthpiece 52.

With additional reference to FIGS. 4-10, the tank 70 is defined by a tubular outer wall 72. The base 60 defines a transverse base wall 62 having a cross-sectional shape generally matching that of the tubular outer wall 72. A distal portion 64 of the base 60 defines a threaded base pin 65 that is configured to threadingly engage the internal threads 42 of the battery assembly mount boss 30. A connector pin 66 is disposed within the battery mount 55 of the base 60, and an insulating sleeve 67 is interposed between the base pin 65 and the connector pin 66 so that the base pin 65 and connector pin 66 are electrically isolated from one another. Preferably, the connector pin 66 is configured so that when the base pin 65 is threadingly engaged with threads 42, the connector pin 66 engages the battery contact 44. As such, the base pin 65 and connector pin 66 connect to opposing battery poles.

The tubular tank wall 72 has a proximal end 74 with a top, or proximal, opening 75, and a bottom, or distal, end 76. In the illustrated embodiment, the bottom end 76 has an inwardly-extending bottom lip 77. The bottom end 76 of the tank wall rests upon the transverse base wall 62. The base wall 62 can include a sealing 68 seat configured to accept a sealing member such as an O-ring or sealing washer.

A proximal sleeve 80 extends proximally from the transverse base wall 62 and terminates at a proximal end 82. A proximal flange 84 extends inwardly adjacent the proximal end 82. A plurality of access apertures 86 are formed through the proximal sleeve 80. In the illustrated embodiment, at least a pair of the access apertures 86 are on opposing sides of the proximal sleeve 80 and aligned with one another.

Figure 10:
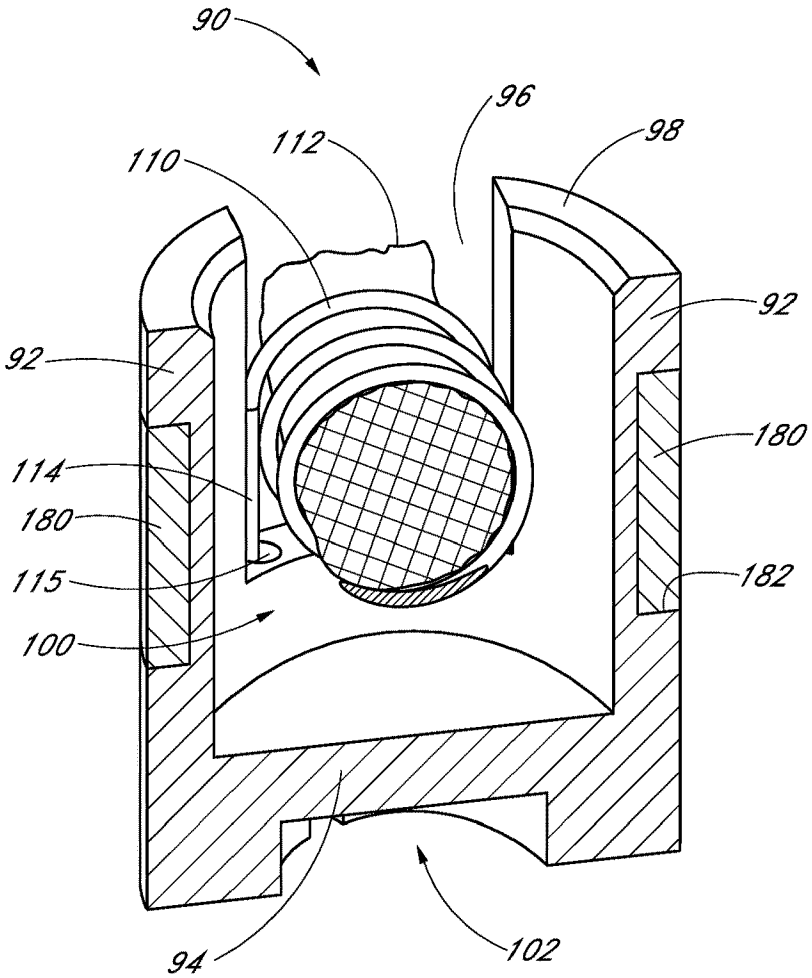
FIG. 10 is a cross-sectional view taken along lines 10-10 of FIG. 9.
Figure 9:
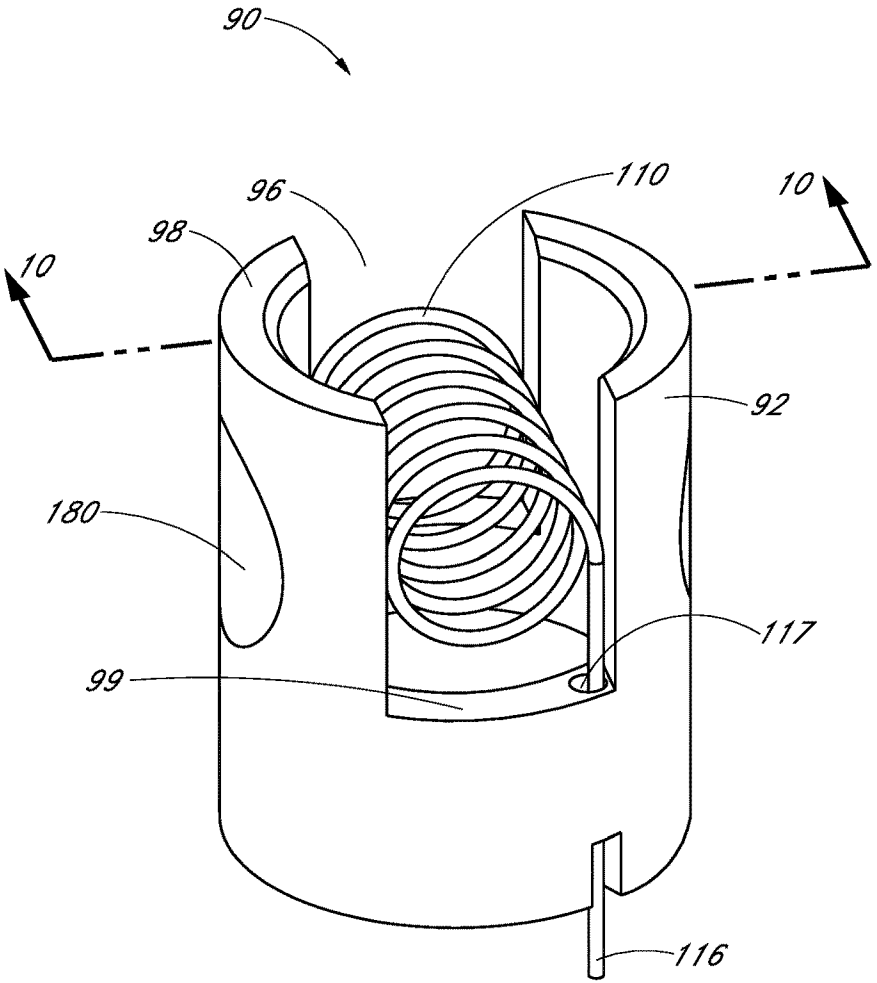
FIG. 9 is a perspective view of an assembled atomizer cup and heating coil.
Figure 11:
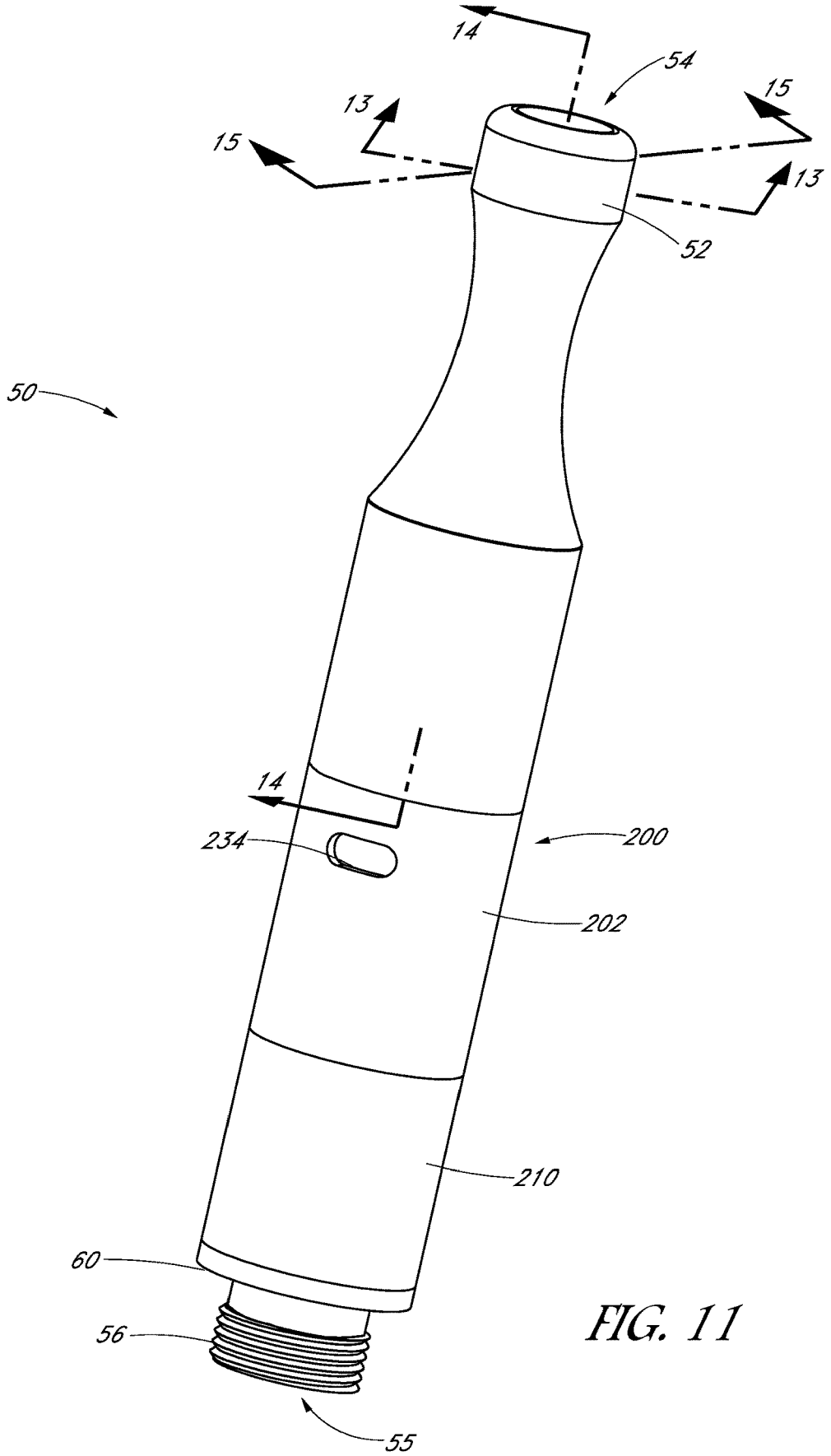
FIG. 11 is a perspective view of another embodiment of a personal vaporizer for use with the battery assembly of FIG. 1.
Figure 12:
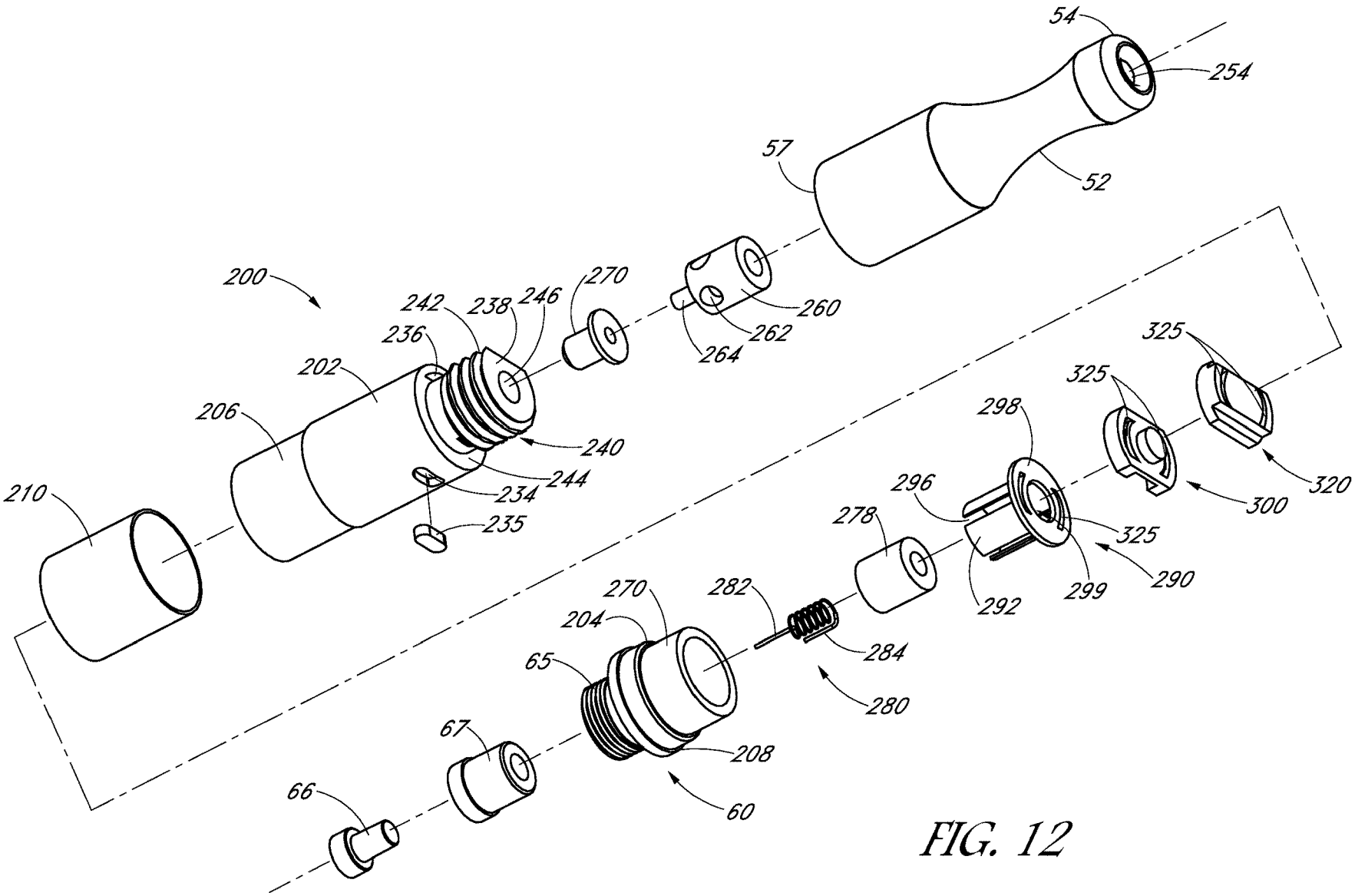
FIG. 12 is an exploded view of the personal vaporizer of FIG. 11.
Figure 13:
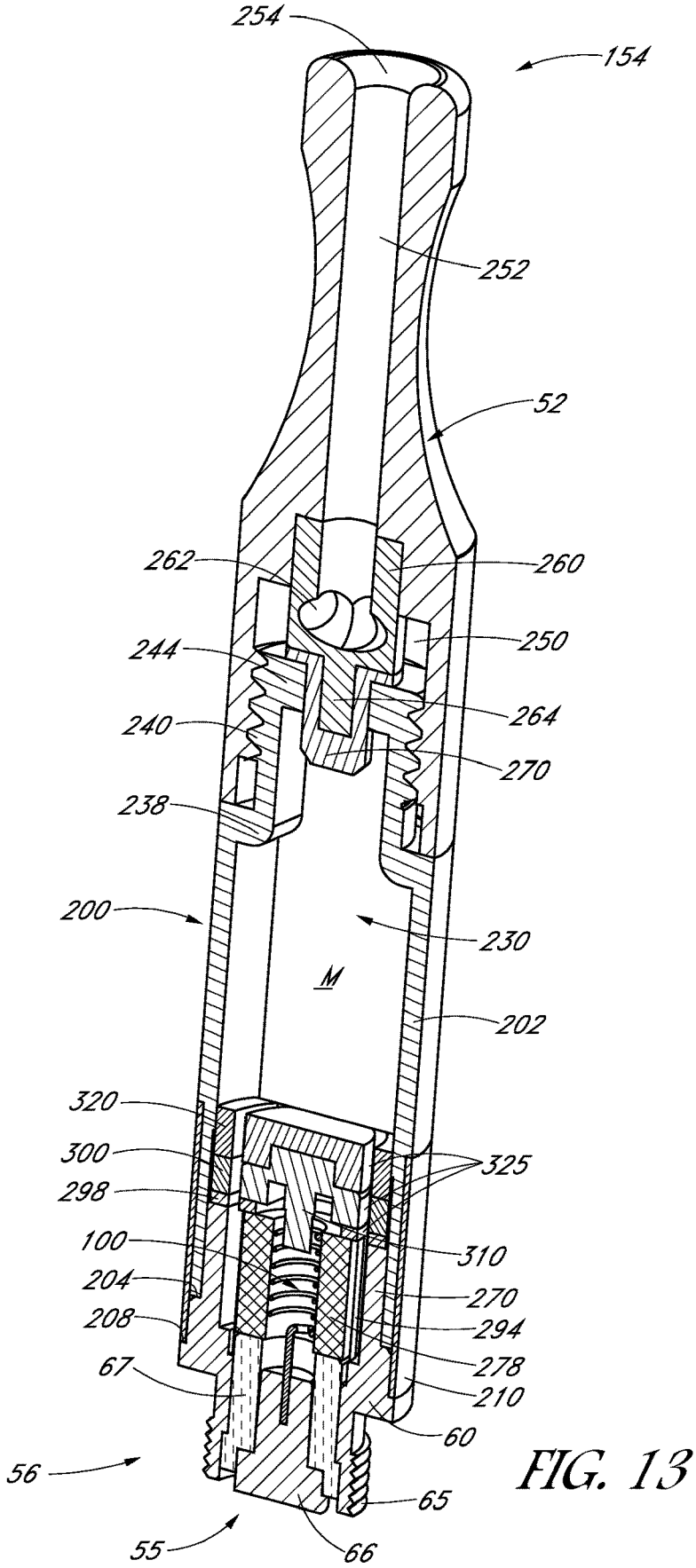
FIG. 13 is a cross-sectional view taken along lines 13-13 of FIG. 11.
Figure 14:
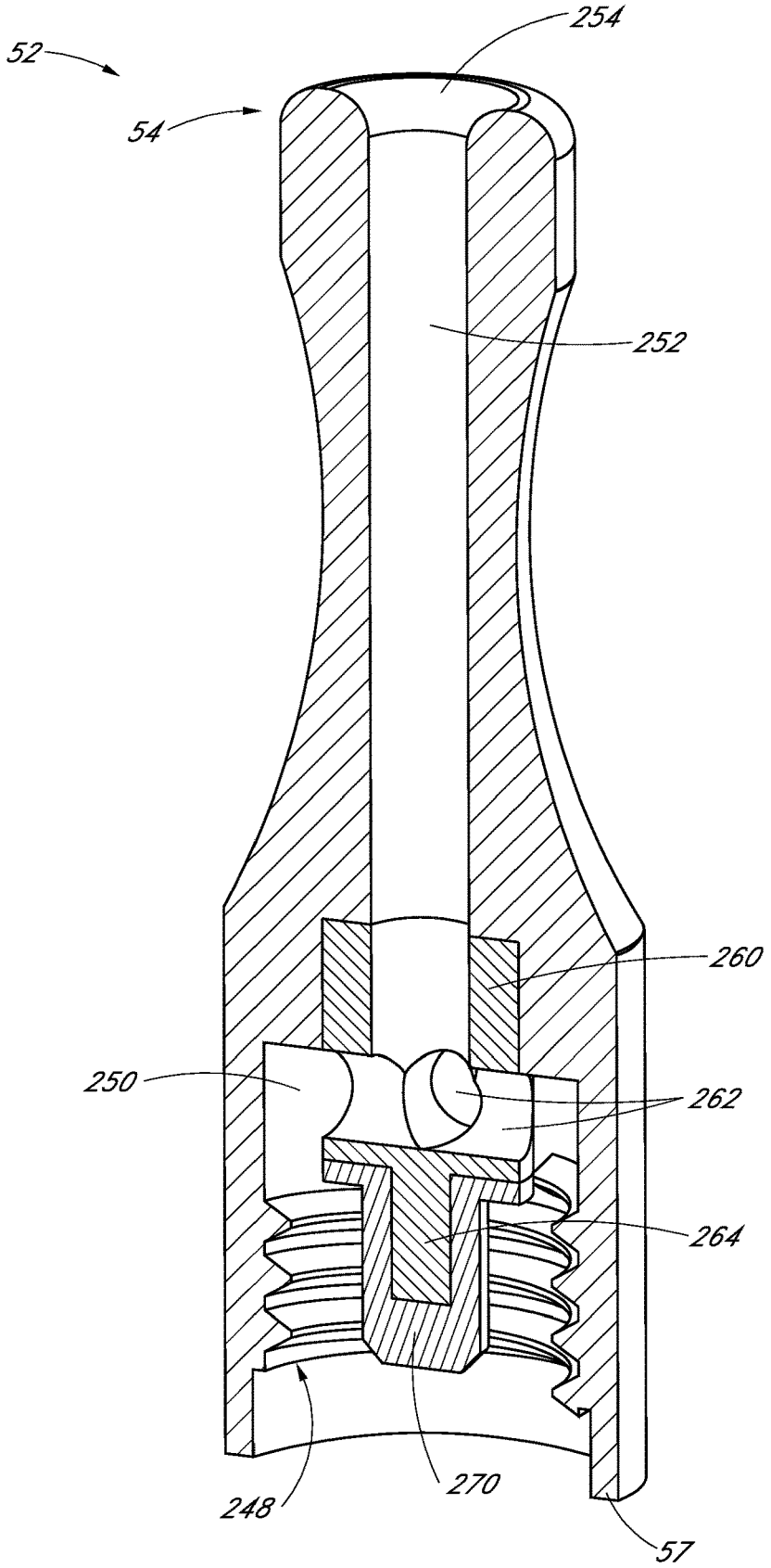
FIG. 14 is a cross-sectional view of the mouthpiece of the personal vaporizer of FIG. 11, taken along lines 14-14.
Figure 15:
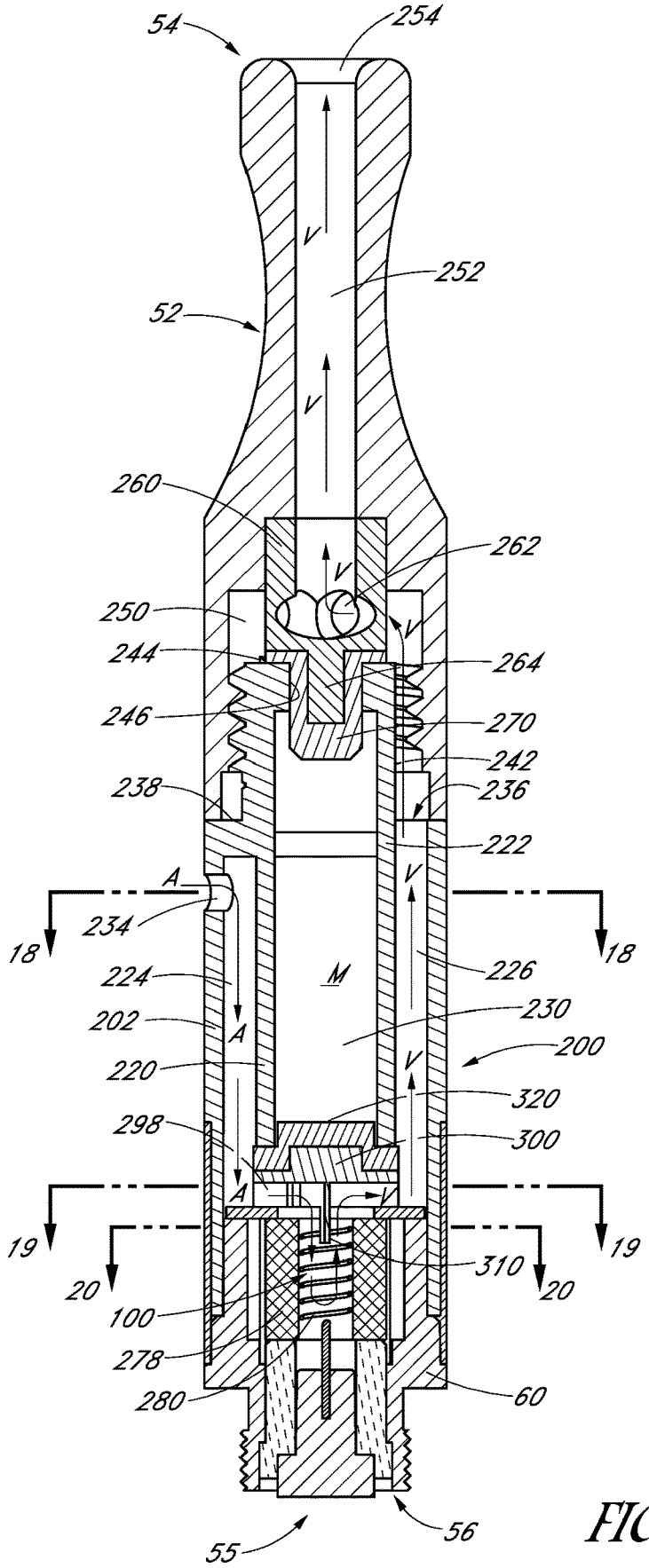
FIG. 15 is a cross-sectional view taken along lines 15-15 of FIG. 11.
Figure 16:
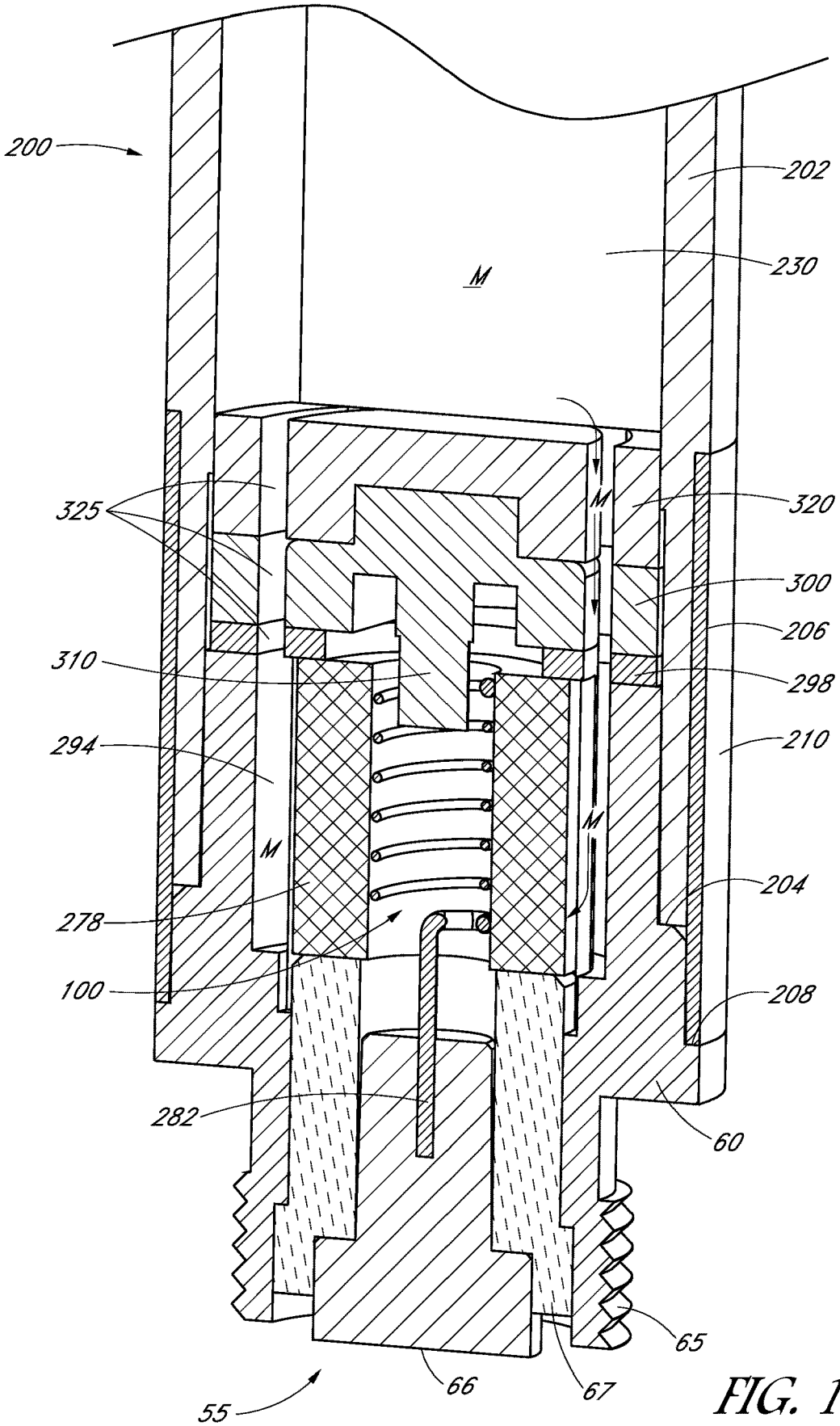
FIG. 16 is a close-up view of a distal portion of the arrangement of FIG. 13.
Figure 17:
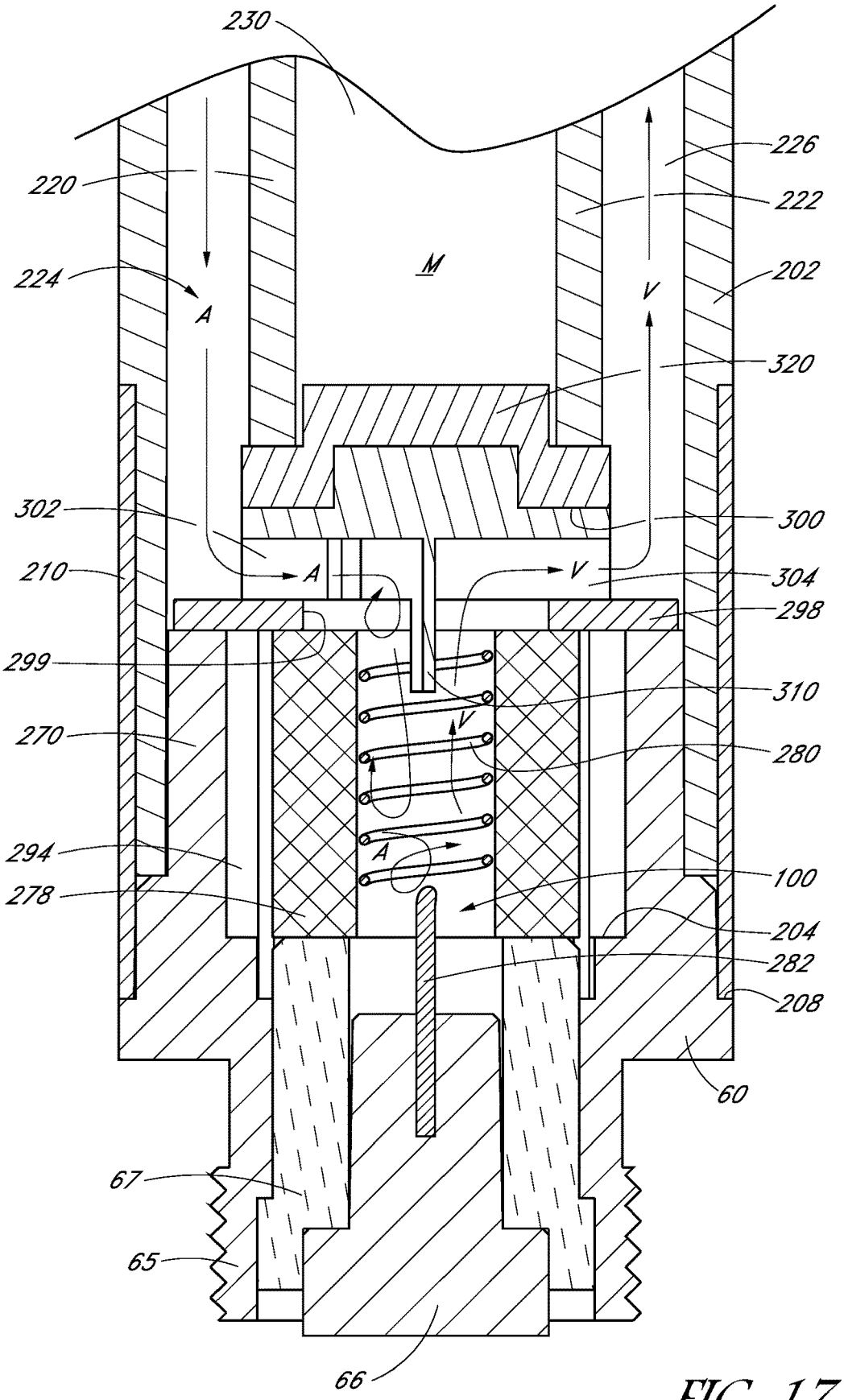
FIG. 17 is a close-up view of a distal portion of the arrangement of FIG. 15.
Figure 18:
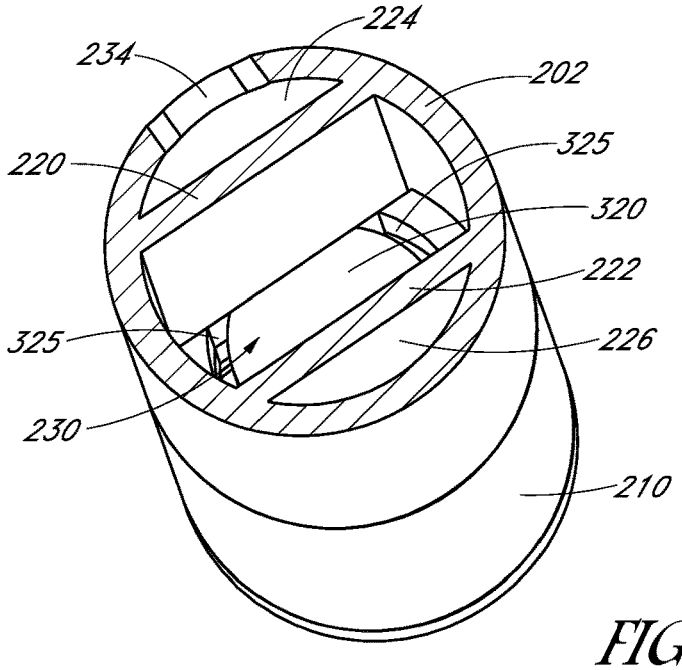
FIG. 18 is a cross-sectional view taken along lines 18-18 of FIG. 15.
Figure 19:
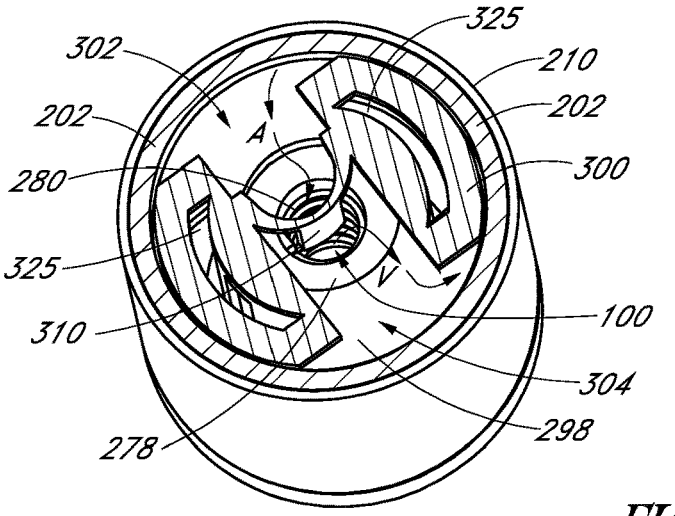
FIG. 19 is a cross-sectional view taken along lines 19-19 of FIG. 15.

An atomizer cup 90 is configured to fit within the proximal sleeve 80 of the base 60. As best shown in FIGS. 9 and 10, the atomizer cup 90 is defined by elongated side walls 92 and a transverse wall 94. A vaporization chamber 100 is defined within the atomizer cup 90 proximal of the transverse wall 94, and a heating element 110 is disposed within the vaporization chamber 100. In the illustrated embodiment, opposing feed slots 96 extend through the side walls 92, and each feed slot 96 extends distally from a proximal end 98 of the cup 90 to a slot end wall 99. The atomizer cup 90 preferably is formed of a heat-tolerant material that is not electrically conductive, such as certain ceramic materials.

In the illustrated embodiment, the atomizer cup 90 is received within the proximal sleeve 80 of the base 60 and arranged so that the proximal end 98 engages a proximal flange 84 of the base 60, and is thus held securely in place. The feed slots 96 of the atomizer cup 90 preferably are aligned with corresponding access apertures 86 of the base proximal sleeve 80.

In the illustrated embodiment, the heating element 110 comprises a wire coil wrapped about an elongated wick 112. The wire coils 110 can be constructed of a durable, electrically-conductive material such as a metal (such as titanium, kanthal, or nichrome) that provides durability and high heat production when energized. The wick 112 can be formed of any suitable wicking material such as a deformable cotton and/or silica material, or even ceramic-based materials.

The coil 110 has a first end 114 that extends through a first aperture 115, and a second end 116 that extends through a second aperture 117. The first and second apertures 115, 117 are formed within the atomizer cup side wall 92 and each opens through opposite ones of the slot end walls 99. As shown, the heating coil 110 preferably is arranged so that an axis of the coil is directed transverse to an axis of the personal vaporizer, extending between the feed slots 96, which are aligned with the access apertures 86 of the base. Preferably, the wick 112 is arranged along the heating coil axis, and extends through the feed slots and access apertures In the illustrated embodiment, a proximal end of the connector pin 66 extends into a distal cavity 102 of the atomizer cup 90 formed distal of the transverse wall 94. The first wire end 114 can be bent inwardly so as to be sandwiched between the proximal end of the connector pin 66 and the transverse wall 94. The second wire end 116 can be pressed into engagement with the base 60, which preferably is formed of an electrically conductive material such as a metal. As such, electrical energy from the battery 20 can be communicated along an electrical circuit from the battery contact 44 to the connector pin 66 and to the first end 114 of the wire. Such electrical energy is delivered through the heating coil 110 and to the second wire end 116 and further to the base 60, which includes the base pin 65, from which it is communicated to the opposite pole of the battery at threads 42.

The mouthpiece 52 has a distal cavity 104 that communicates with an elongated outlet 106 passage, which outlet passage opens at a mouthpiece outlet 108 formed through the proximal end 54 of the mouthpiece 52. A plurality of inlet apertures 118 are formed through an outer wall of the mouthpiece 52, opening into the distal cavity 104. An intake insert 120 includes a proximal portion 122 that is received within the mouthpiece distal cavity 104. In the illustrated embodiment, a pair of spaced-apart circumferential seal seats 124 are formed in the proximal portion of the intake insert, and a sealing ring, such as an o-ring 126, is configured to fit within each seal seat 124 so as to sealingly engage an inner surface of the distal cavity 104.

A flange 130 extends circumferentially about the intake insert 120 distal of the proximal portion 122. When the proximal portion 122 of the intake insert 120 is received within the mouthpiece distal cavity 104, a distal end 57 of the mouthpiece engages a proximal face of the flange 130. A distal portion 132 of the intake insert 120 extends distally from the flange 130, and includes a circumferential seal seat 134 configured to receive a sealing ring 136 such as an o-ring. The distal portion 132 of the intake insert 120 is configured to be received through the top opening 75 of the tank wall 72 so that the sealing ring 136 sealingly engages an inner surface of the tank wall 72 and the proximal end 74 of the tank wall 72 engages a distal surface of the intake insert flange 130. In the illustrated embodiment, an outer surface of the flange 130 is configured to align with outer surfaces of both the mouthpiece 52 and tank wall 72. As such, the tank 70 is defined within the tank wall 72 and between the transverse wall 62 of the base 60 and the flange 130 of the intake insert 120.

The intake insert 120 comprises a plurality of inlet passages 138 sized and configured to align with and communicate with the inlet apertures 118 formed in the mouthpiece 52. The inlet passages 138 communicate with an inlet manifold 140 formed within the intake insert 120. In the illustrated embodiment, the inlet manifold 140 is part of a distal lumen 142 formed along an axis of the intake insert 120. A proximal lumen 144 is formed proximal of but aligned with the distal lumen 142, and has a reduced diameter relative to the distal lumen 142. The proximal lumen 144 terminates at a proximal aperture 146, which has an even further-reduced diameter.

An elongated vapor tube 150 defines a vapor passage 152 therewithin. In the illustrated embodiment, the proximal lumen 144 is sized and configured to receive a proximal end of the vapor tube 150 therewithin so that the proximal end of the vapor tube 150 engages a tube seat 154 defined where the proximal lumen 144 transitions to the proximal aperture 146. As such, the vapor passage 152 opens into the proximal aperture 146 and thus communicates with the outlet passage 106. In the illustrated embodiment, the elongated vapor tube 150 extends distally from the intake insert 120 so that a distal end of the vapor tube 150 is proximal to, yet adjacent, the heating coil 110. In a preferred embodiment, the distal end of the vapor tube 150 is disposed within the vaporization chamber 100, distal of the proximal end 98 of the atomizer cup 90. A distal opening 156 of the vapor tube 150 is disposed at the distal end, so that the vapor passage 152 extends from the vaporization chamber 100 to the mouthpiece outlet passage 106.

An elongated delivery tube 160 has a proximal end attached to the intake insert 120 in the distal lumen 142 and extends distally therefrom and concentrically surrounds the vapor tube 150. In the illustrated embodiment, the proximal end of the delivery tube 160 threadingly engages the intake insert 120. However, it is to be understood that other methods and structure, such as press-fitting and the like, can be employed to attach the delivery tube 160 to the intake insert 120.

A distal portion 162 of the delivery tube 160 has an increased diameter relative to the proximal portion, and a tapered portion 163 increases the diameter moving distally along the delivery tube to the distal portion 162. In the illustrated embodiment, an outwardly-extending distal flange 164 is disposed at a distal end of the delivery tube 160. The distal end of the delivery tube 160 engages a tube seat 166 formed on the base 60 so that the distal flange 164 overlaps and is just proximal of the inwardly-extending bottom lip 77 of the tank wall 72. As such, the bottom lip 77 of the tank wall 72 is sandwiched between the delivery tube distal flange 164 and the transverse wall 62 of the base 60.

The distal portion 162 of the delivery tube 160 is sized and configured to fit over the proximal sleeve 80 of the base 60. In a preferred embodiment, the delivery tube 160 contacts and is attached to the proximal sleeve 80, such as in a press-fit configuration. Of course, other methods and structures for attachment, such as threaded attachment, adhesive, clips, or the like, can be employed. In this manner, the delivery tube 160 separates the tank 70 from the vaporization chamber 100.

Feed apertures 168 are formed through the delivery tube 160 in the distal portion 122. The feed apertures 168 are aligned with the access apertures 86 of the base 60 proximal sleeve 80 and feed slots 96 of the atomizer cup 96 so that the wick 112 extends into the feed apertures 96. As such, vaporizing medium M within the tank 70 can flow into ends of the wick 112 to be drawn thereby into the vaporization chamber 100. Preferably, the vaporization chamber 100 is otherwise sealed from the tank 70.

In the illustrated embodiment, a delivery passage 170 is defined between the delivery tube 160 and the vapor tube 150. A proximal opening 172 of the delivery passage 170 is disposed within the intake insert 122 and communicates with the intake manifold 140. In the illustrated embodiment, a cross-sectional area of the proximal opening 172 is less than a combined cross-sectional area of the inlet passages 138. As such, air A that enters the inlet manifold 140 through the inlet apertures 118 and inlet passages 138 is accelerated as it is drawn through the proximal opening 172 of the delivery passage 170. An atomizer inlet 174 is defined between the vapor tube 150 and the atomizer cup 90, and defines a distal opening 174 of the delivery passage 170.

When the heating coil 110 is actuated and a user draws a breath through the mouthpiece 52, atmospheric air A is drawn through the inlets 118 and delivery tube 160 and delivered, travelling in a distal direction through the delivery passage 170, to the vaporization chamber 100. At the same time, vaporizing medium M is atomized by the heating coil 110. Intake air A preferably becomes turbulent as it changes direction within the vaporization chamber 110 and flows across the wick 112 and heating coil 110. Atomized medium becomes entrained in the air A, forming a vapor V that is drawn proximally into the vapor tube 150, and flows therethrough to the mouthpiece 52 and into the user's mouth.

In the illustrated embodiment, a distal space 176 is defined in the delivery passage 170 between the tapered portion 163 of the delivery tube 160 and the vapor tube 150. A cross-sectional area of the delivery passage 170 increases in the distal space 176, and flow turbulence can be expected to occur in this distal space 176. The atomizer inlet 174 communicates with the distal space 176. A cross-sectional area of the delivery passage 170 at the atomizer inlet 174 preferably is much less than a cross-sectional area of the delivery passage in the distal space 176. As such, as air A flows from the distal space 176 through the atomizer inlet 174, the air is again accelerated. However, since at least a portion of the air A has become turbulent in the distal space 176, at least some such turbulence is maintained as the air A is accelerated through the atomizer inlet 174 and into the vaporization chamber 100.

Further, in the illustrated embodiment, the atomizer inlet 174 concentrically surrounds the distal opening 156 of the vapor passage 152, and is proximal and adjacent the heating coil 110. As such, air A is delivered into the vaporization chamber 100 generally toward the sides of the heating coil 110. Thus, much or most of the air A is directed below (distal) the coil 110 and is redirected by the transverse wall 94. Concurrently, vapor V may be being drawn proximally. The proximal draw and distal delivery flows can interfere with one another, causing further turbulence, which enables more thorough entrainment of the atomized medium in the air, leading to a fuller vapor V. In the illustrated embodiment, a cross-sectional area of the distal opening 150 of the vapor passage 152 is far greater than the cross-sectional area of the distal opening 174 of the delivery passage 170. As such, the velocity of vapor V drawn into the vapor passage 152 from the vaporization chamber 100 is much less than the velocity of delivery air A entering the vaporization chamber 100. Thus, delivery air A is delivered effectively distal of the heating coil 110 and is drawn relatively slowly proximally over the wick 112 and coil 110 to the vapor tube 150 so as to enhance absorption of entrained vaporizing media.

In the illustrated embodiment, the heating coil 110 has a generally horizontal axis that is generally normal to an axis of the personal vaporizer. It is to be understood that, in additional embodiments, the heating coil can be arranged differently. For example, in some embodiments, the heating coil can be arranged vertically within the vaporization chamber. In still further embodiments the heating coil can be arranged vertically and the wick may concentrically surround the heating coil so that the vaporization chamber is defined within the heating coil and aligned with the vapor tube.

In the present embodiment, the personal vaporizer 50 is anticipated to be able to be usable with a wide range of vaporizing media. Various vaporizing media M may be expected to have different viscosities. Low viscosity media will flow readily distally within the tank 70 to and through the feed apertures 168 to the wick 112 and into the vaporization chamber 100. High viscosity media, however, may flow slowly, particularly through narrower zones, such as between the distal portion of the delivery tube 170 and the tank wall 72, and further through the feed apertures 168. If the media flows too slowly, vapor production may suffer. In an additional embodiment, a pre-heating structure is provided to supply localized heat to vaporizing medium in the tank, before such media reaches the vaporizing chamber. Preferably, such pre-heating structure warms the media sufficient to lower its viscosity so as to increase flow to and through the feed apertures 168 and wick 112, but does not atomize the media.

Figure 8:
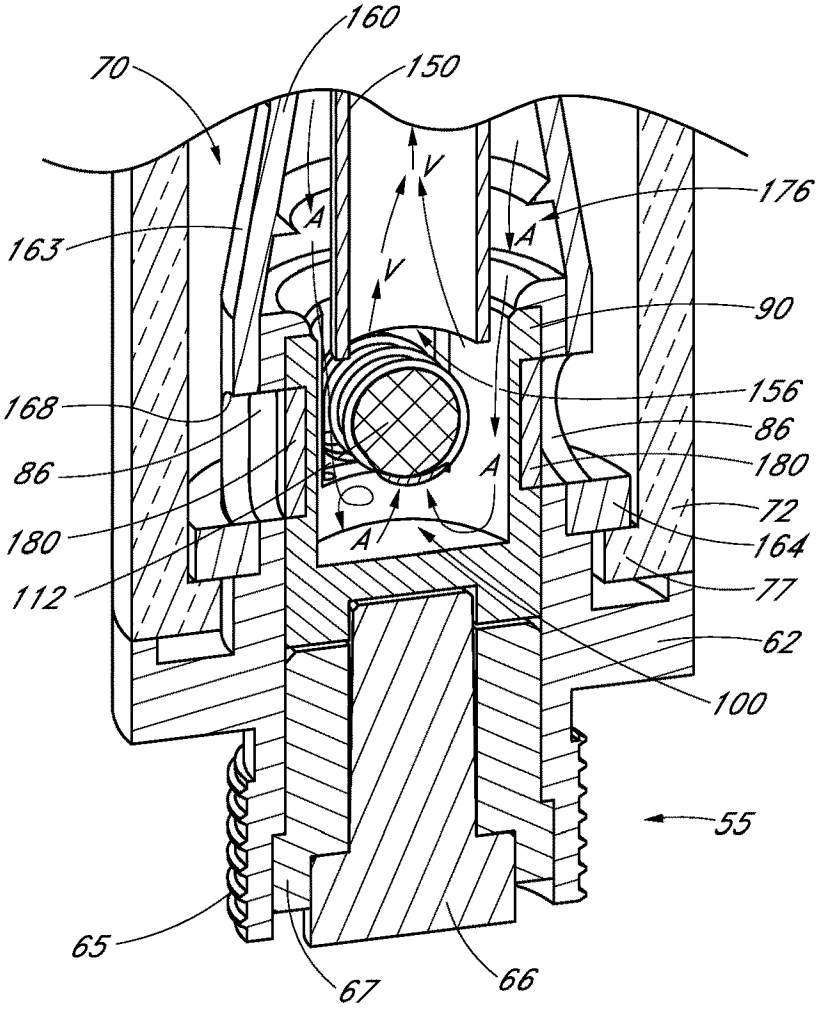
FIG. 8 is a close-up view of a distal portion of the view depicted in FIG. 5.
Figure 7:
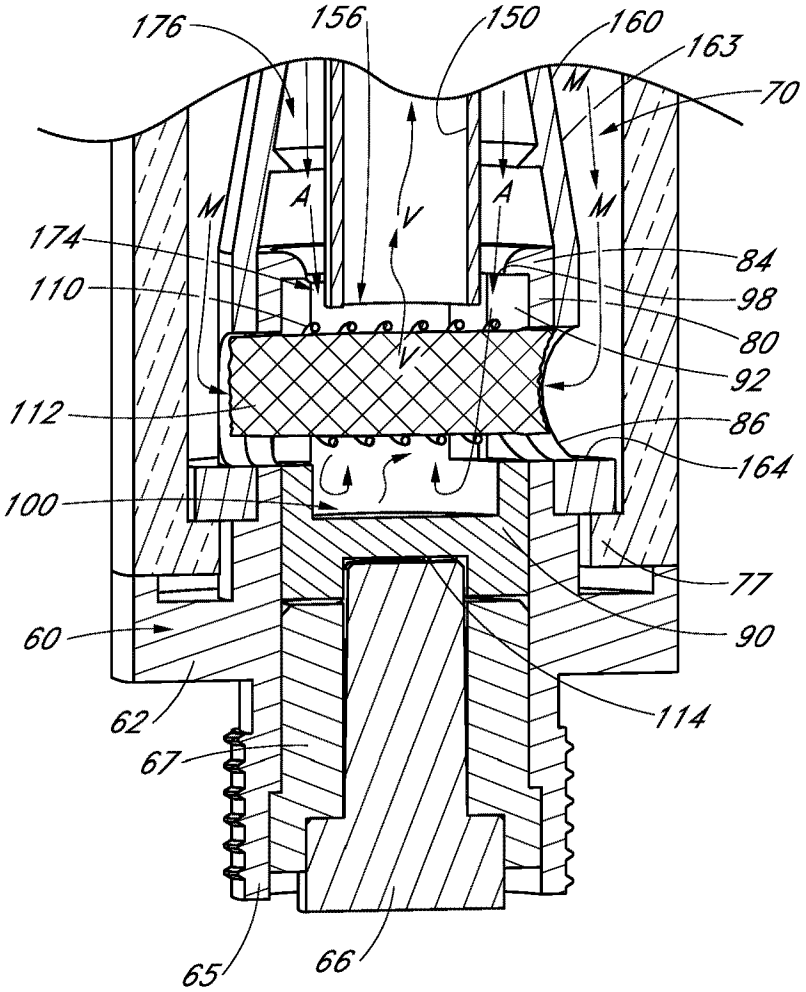
FIG. 7 is a close-up view of a distal portion of the view depicted in FIG. 6.

With particular reference next to FIGS. 8-10, in the illustrated embodiment, a pair of opposing warming elements 180 are embedded in the atomizer cup side wall 92. The warming elements 180 comprise a heat-conductive material such as a metal. Each warming element sits in a warmer seat 182 defined in the atomizer cup side wall 92, which warmer seat 182 may comprise a cavity formed in the side wall. In the illustrated embodiment, no power is supplied to the warming elements 180. However, when the heating coil 110 is actuated, a portion of the heat generated by the heating coil 110 is communicated through the thinned portion of the cup side wall 92 at the warmer seat 182 and into the warming element 180. As such, the warming element 180 is warmed by the coil 110, but does not reach a temperature comparable to that of the coil 110. Consistent with the art, the heating coil 110 attains a fairly high temperature in order to atomize the vaporizing medium M. The portion of heat communicated to the warming element 180 by the heating coil 110 preferably is substantially reduced. In some embodiments, the warming elements 180 can extend all the way through the atomizer cup side wall 92 and into the vaporization chamber 100.

In the illustrated embodiment, feed apertures 168 of the delivery tube 160 and access apertures 86 of the base 60 are aligned with one another and with warming elements 180 of the atomizer cup 90 so that vaporizing media M within the tank 70 is placed into contact with the warming elements 180. The warming elements 180 thus provide localized heat delivery to vaporizing media M within the tank 70 and near the feed apertures 168. Such heat has the effect of decreasing viscosity of the media, and improving flow of the media M within the distal region of the tank 70, which thus helps ensure an appropriate flow of vaporizing media to and through the feed apertures 168 and wick 112 and into the vaporization chamber 100. Preferably, however, such heat is not sufficient to substantially atomize the vaporizing media M within the tank 70. Also in the illustrated embodiment, the warming elements 180 are shaped to generally align with the outer surface of the atomizer cup 90. It is to be understood that, in other embodiments, the warming elements can be shaped to extend substantially into the tank. In some embodiments, metallic members, such as wires, can be attached to the warming elements to extend into the tank. In still further embodiments, further warming elements may be attached to a portion of the tank wall 72, and heat-communicative elements can extend from the warming elements to the further warming elements.

In the illustrated embodiment, the warming elements 180 are not separately powered. In another embodiment, wire apertures can be provided within the atomizer cup to provide electric power to the warming elements. Preferably, such warming elements will be configured to exude substantially less heat when powered than does the heating element 110. Such warming elements can be arranged electrically in series with the heating coil. In still additional embodiments such warming elements can be arranged electrically in parallel with the heating coil. In such arrangements, the warming elements are powered at the same time as the heating coil 110.

Still further embodiments may use different structure to achieve the concept of pre-warming vaporizing medium in the distal portion of the tank in order to decrease viscosity and ensure sufficient supply and flow of vaporizing media M to the vaporization chamber 100. For example, in some embodiments, rather than access apertures 86, the base 60 and delivery tube 160 can also include thermally conductive warming elements to communicate heat from the atomizer cup warming elements to the vaporizing media M within the tank. In still further embodiments, powered warming elements can be incorporated into or attached to the distal portions of the delivery tube, tank wall, or the like.

With reference next to FIGS. 11-20, another embodiment of a personal vaporizer 50 also comprises a mouthpiece 52 at its proximal end 54 and a battery mount 55 at its distal end 56. The battery mount 55 comprises a threaded base pin 65 spaced from a connector pin 66. An insulating sleeve 67 keeps the base pin 65 out of electrical contact with the connector pin 66. The base pin 65 is part of a conductive base 60. As in embodiments as discussed above, the battery mount 35 is configured to connect a battery 20 to the vaporizer 50 so that the base pin 65 and connector pin 66 are connected to opposing battery poles, and power from the battery 20 can be supplied to the vaporizer 50.

An elongated center section 200 is positioned between the mouthpiece 52 and the base 60. An outer wall 202 of the center section 200 extends from a distal end of the mouthpiece 52 to a wall seat 204 of the base 60. In the illustrated embodiment, a sleeve 210 is disposed over a distal portion 206 of the outer wall 202 and a portion of the base 60 and engages a sleeve seat 208 of the base 60. The outer wall 202 defines a center section lumen. A pair of elongated inner walls—an inlet inner wall 220 and an outlet inner wall 222—extend across the center section lumen, dividing the center section lumen into an elongated inlet passage 224, an elongated outlet passage 226, and an elongated tank 230 between the inlet and outlet passages 224, 226. An inlet 234 is formed through the outer wall 202 and in communication with the inlet passage 224 so that atmospheric air A can enter the inlet passage 224 through the inlet 234. In some embodiments, a removable inlet stopper 235 can be received in the inlet 234.

At a proximal end of the outer wall 202, a proximal wall 238 extends transversely and inwardly generally about the circumference of the center section 200, except that a vapor opening 236 is formed at the proximal end of the outlet passage 226. A proximal portion 240 of the center section 200 extends proximally of proximal ends of the outer wall 202 (and proximal wall 238), and accordingly has a reduced diameter relative to the outer wall 202. At least part of the proximal portion 240 is threaded on an outer surface thereof. In the illustrated embodiment, the threads are discontinuous, so that the part of the proximal portion that aligns with the outlet inner wall 223 (and the vapor opening 236) defines a flat surface 242 that is not threaded, although the threads extend about the remainder of the circumference of the proximal portion 240.

A proximal end of the center section also defines a top wall 244 of the tank 230, which top wall 244 has a fill hole 246 formed therethrough and providing access to the tank 230. Preferably, the fill hole 246 is aligned with an axis of the vaporizer 50.

The mouthpiece 52 comprises an internally-threaded distal portion 248 configured to threadingly engage the threads of the proximal portion 240 in order to connect the mouthpiece 52 to the center section 200. A space 250 is provided within the mouthpiece 52 proximal of the threads so that a vapor space 250 is defined between the mouthpiece 52 and the top wall 244 of the center section 200 when the mouthpiece 52 is connected to the center section 200. A mouthpiece passage 252 extends to, and opens at, an outlet 254 on the proximal end 54 of the mouthpiece 52. An insert 260 is provided in the mouthpiece 52 and aligned with the mouthpiece passage 252. The insert 260 includes a plurality of ports 262 that communicate with the vapor space 250 so that vapor within the vapor space 250 can flow through the ports 262 and into the mouthpiece passage 252.

A stopper boss 264 extends distally from a body of the insert 260, and supports an elastomeric stopper 270 fitted thereon. Preferably, the stopper boss 264 and stopper 270 are aligned with an axis of the mouthpiece 52. As such, when the mouthpiece 52 is threaded onto the center section 200, the stopper 270 is pushed into and through the fill hole 246, plugging the fill hole 246 so that vaporizing medium M within the tank 230 will not leak out through the fill hole 246.

Preferably the stopper 270 is connected to the stopper boss 264 sufficiently so that the stopper 270 moves longitudinally with the stopper boss 264. Specifically, when the mouthpiece 52 is unthreaded from the center section 200, the stopper 270 moves with the mouthpiece 52 proximally relative to the center section 200, and is drawn out of the fill hole 246, enabling a user to fill the tank 230 through the fill hole 246. In order to ensure the elastomeric stopper 270 moves with the mouthpiece 52 when the mouthpiece 52 is removed from the tank 230, the mouthpiece boss 264 can, in some embodiments, include retaining structures (such as barbs, pins, rails, rings, protuberances, and the like) that prevent the stopper 270 from moving distally off of the boss.

In some embodiments, the boss 264 may include a raised ring, which may be inclined proximally. The support may include a ring receiver shaped to complementarily receive the ring. When engaged, the ring and receiver block the stopper from moving distally relative to the stopper boss when the mouthpiece is unthreaded from the tank threads of the center section. When engaged plugging the fill hole 246, the stopper 270 may be subject to significant compressive force. The ring structure enables rotational movement of the stopper relative to the stopper base while blocking distal relative movement.

In the illustrated embodiment, the base 60 of the personal vaporizer includes a tubular proximal portion 270 into which a tubular wick 278 is placed. A helical heating coil 280 is disposed within, and preferably in contact with, an inner surface of the tubular wick 278. A first end 282 of the heating coil 280 is attached to the conductive pin 66. A second end 284 of the heating coil 280 is directed distally (such as through a passage defined in the wick) and into contact with the base 60. As such, electric power from the battery 20 supplied to the conductive pin 66 flows through the heating coil 280 to the base 60 and base pin 65, and from the base pin 65 back to the battery 20. A vaporization chamber 100 is defined within the tubular wick 278.

Figure 20:
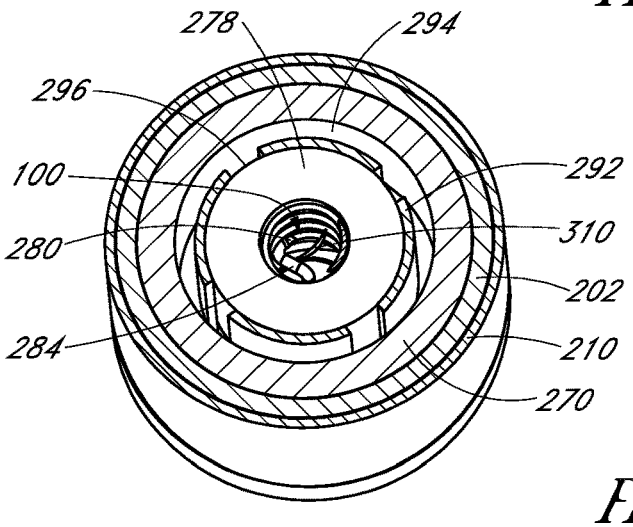
FIG. 20 is a cross-sectional view taken along lines 20-20 of FIG. 15.

A space is defined between the inner surface of the tubular proximal portion 270 of the base and an outer surface of the wick 278. As best shown in FIG. 20, the wick 278 preferably is enclosed within a wick wall 292, which supports the wick 278 (which may be formed of a deformable cotton and/or silica material), thereby helping the wick 278 keep its shape. In the illustrated embodiment, the wick wall 292 is part of a base insert 290 into which the wick 278 is placed, and which is placed in the tubular proximal portion 270 of the base 60. As discussed in more detail below, the space defines a media manifold 294. Free spaces 296 are provided through the wick wall 292 to provide access from the media manifold 294 to the wick 278.

In the illustrated embodiment, the base insert 290 includes a disk-shaped spacer 298 from which the wick wall 292 depends. The spacer 298 sits atop the proximal end of the base 60 and the wick 278. The spacer 298 includes a spacer aperture 299 providing access to the vaporization chamber 100 and a portion of the wick 278. A guide member 300 sits atop the spacer 298, and defines an inlet space 302 aligned with a distal end of the inlet passage 224 of the center section 200. The guide member 300 also defines an outlet space 304 aligned with a distal end of the outlet passage 226 of the center section 200. An air guide 310 is disposed between the inlet space 302 and the outlet space 304. A depending portion of the air guide 310 extends distally through the spacer aperture 299, past the proximal end of the wick 278 and heating coil 280 and into the vaporization chamber 100. In the illustrated embodiment, the air guide is arcuate 310, at least on the side toward the inlet space 302, tending to direct air flowing through the inlet space 302 toward a center of the air guide 310. In the illustrated embodiment, the center of the air guide lies along an axis of the vaporization chamber 100.

In the illustrated embodiment, a tank seal 320 is disposed above the guide member 300. The illustrated tank seal 320 preferably is formed of an elastomeric material, and engages the inner surfaces of the outer wall 202 and inner walls 223, 224 at the distal end of the tank 230. Preferably, the tank seal 320 also engages the distal ends of the inner walls 222, 224. As such, the distal end of the tank 230 is sealed, so that vaporizing media M will not leak into the inlet or outlet passages 224, 226.

A pair of media 325 channels are formed through opposite sides of the tank seal 320. Corresponding pairs of media channels 325 are also formed through the guide member 300 and spacer 298 and are aligned with the tank seal media channels 325. The media channels 325 are further aligned with the media manifold 294 formed between the inner surface of the base proximal end 270 and the outer surface of the wick 278 (and/or the wick wall 292). As such, media from the tank 230 can flow distally through the media channels 325 and into the media manifold 294. In the illustrated embodiment, the media channels 325 are arcuate, corresponding to the arcuate cross-sectional shape of the media manifold 294.

In the illustrated embodiment, the wick wall 292 is a solid material, such as a metal or ceramic, with spaced apart free spaces 296. In other embodiments the wick wall can be made of a mesh, honeycomb, or other structure, and the free spaces may have various shapes and configurations.

In operation, when a user draws a breath through the mouthpiece 52 while actuating the heating coil 280, air A is drawn through the inlet 234 and into the inlet passage 224.

Such air is drawn distally to the inlet space 302 at the distal end of the inlet passage 224, and thus is redirected radially toward the air guide 310. In the illustrated embodiment, the air guide surface is arcuate on the inlet side so as to direct the air flow toward the middle, or axis, of the air guide 310 which, in the illustrated embodiment, is aligned with the axis of the vaporizer 50. The air guide 310, which depends distally, redirects the air flow distally and into the vaporization chamber 100 defined within the wick 278. The redirected (now distally-directed) air flow comprises turbulent air directed to the distal end of the vaporization chamber 100.

When the heating coil 280 is actuated, vaporizing media M within the wick 278 is atomized. Such atomized media becomes entrained in the air A within the vaporization chamber 100, forming a vapor V. Entrainment of atomized media is enhanced when the air flow is turbulent, and the redirection of intake air by the air guide 310 will tend to create turbulence. Vapor V within the vaporization chamber 100 is displaced by incoming air, being displaced toward the outlet side of the air guide 310, and is also drawn (by the user's draw) proximally out of the vaporization chamber 100 and to the outlet space 304 on the outlet side of the air guide 310. From there the vapor V flows to the outlet passage and proximally through the outlet passage 226 to the vapor space 250 in the mouthpiece 52, through the mouthpiece ports 262 and mouthpiece passage 252 and into the user's mouth. Simultaneously, as vaporizing media M is atomized, the wick 278 draws more media M from the media manifold 294, and additional media is also drawn from the tank 230 via the media channels 325.

As discussed above, some vaporizing media may be very thick, having a high viscosity. Such media may, in some embodiments, resist flowing through the media channels 325, which can be fairly narrow in some embodiments. If the flow is slowed sufficiently so that less media is supplied to the wick than is atomized, insufficient or weak vapor will be formed. As such, some embodiments may employ a pre-warming structure to warm vaporizing media M in a distal portion of the tank 230 so that such media will flow readily from the tank 230 to the wick 278.

Figure 21:
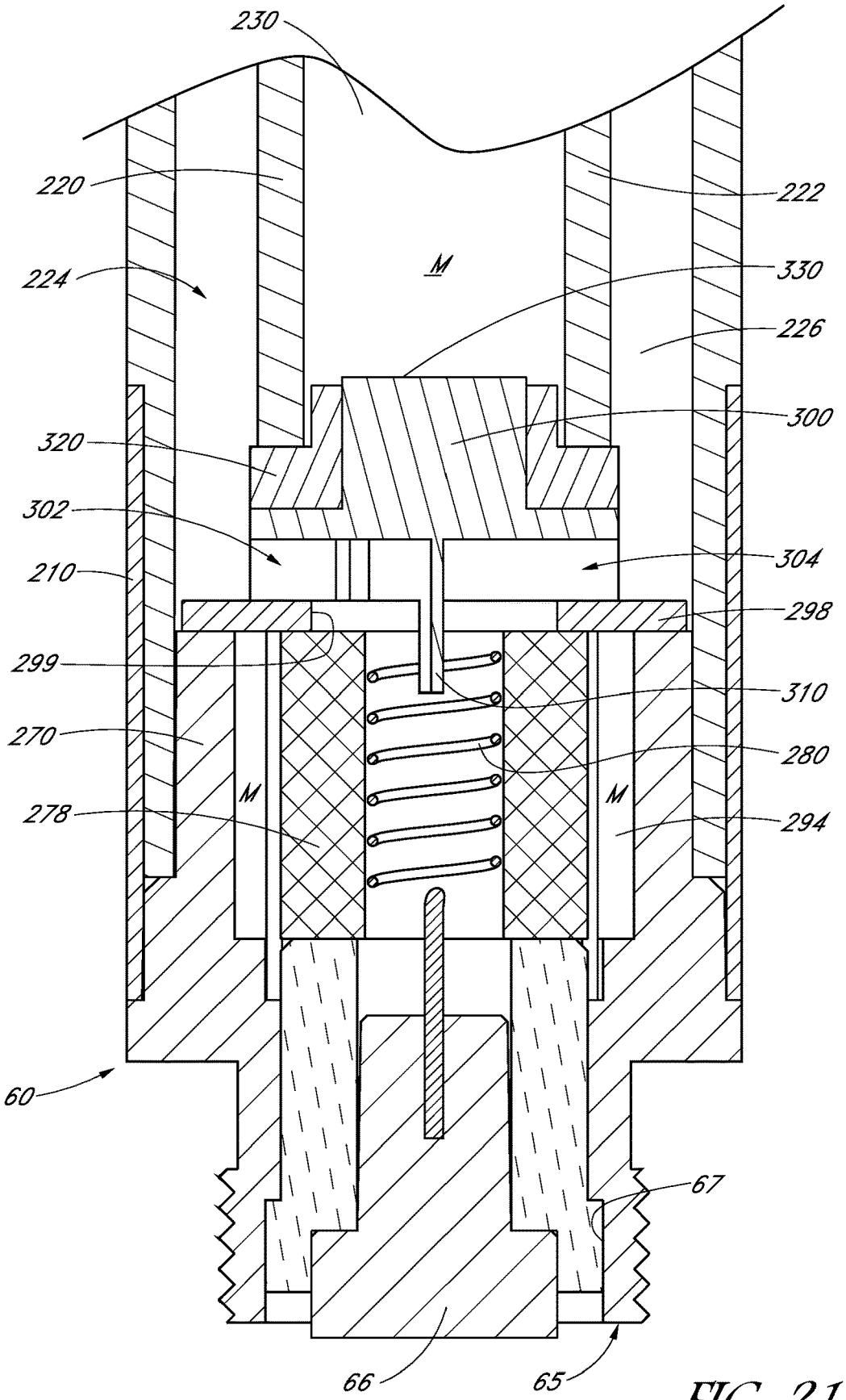
FIG. 21 shows another embodiment of a personal vaporizer, and the view is similar to the view of FIG. 15.

With specific reference next to FIG. 21, in another embodiment the guide member 300 extends proximally through the tank seal 320 and into the distal portion of the tank 230. As such, a proximal surface 330 of the guide member 300 is in contact with vaporizing media M in the tank 230. Preferably the guide member 300 is formed of a material that can communicate a portion of the heat generated by the heating coil 280. Most preferably, the material is selected so that only a portion of the heat generated by the heating coil 280 is absorbed by the air guide 310 and communicated through the guide member 300 to the proximal surface 330 of the guide member 300, from which it flows into the media M. As such, the media M within the tank 230 is warmed sufficient to reduce its viscosity without being atomized, or at least without being substantially atomized. The warmed, reduced-viscosity media M then flows readily through the media channels 325 into the media manifold 294 and into the wick 278.

Figure 22:
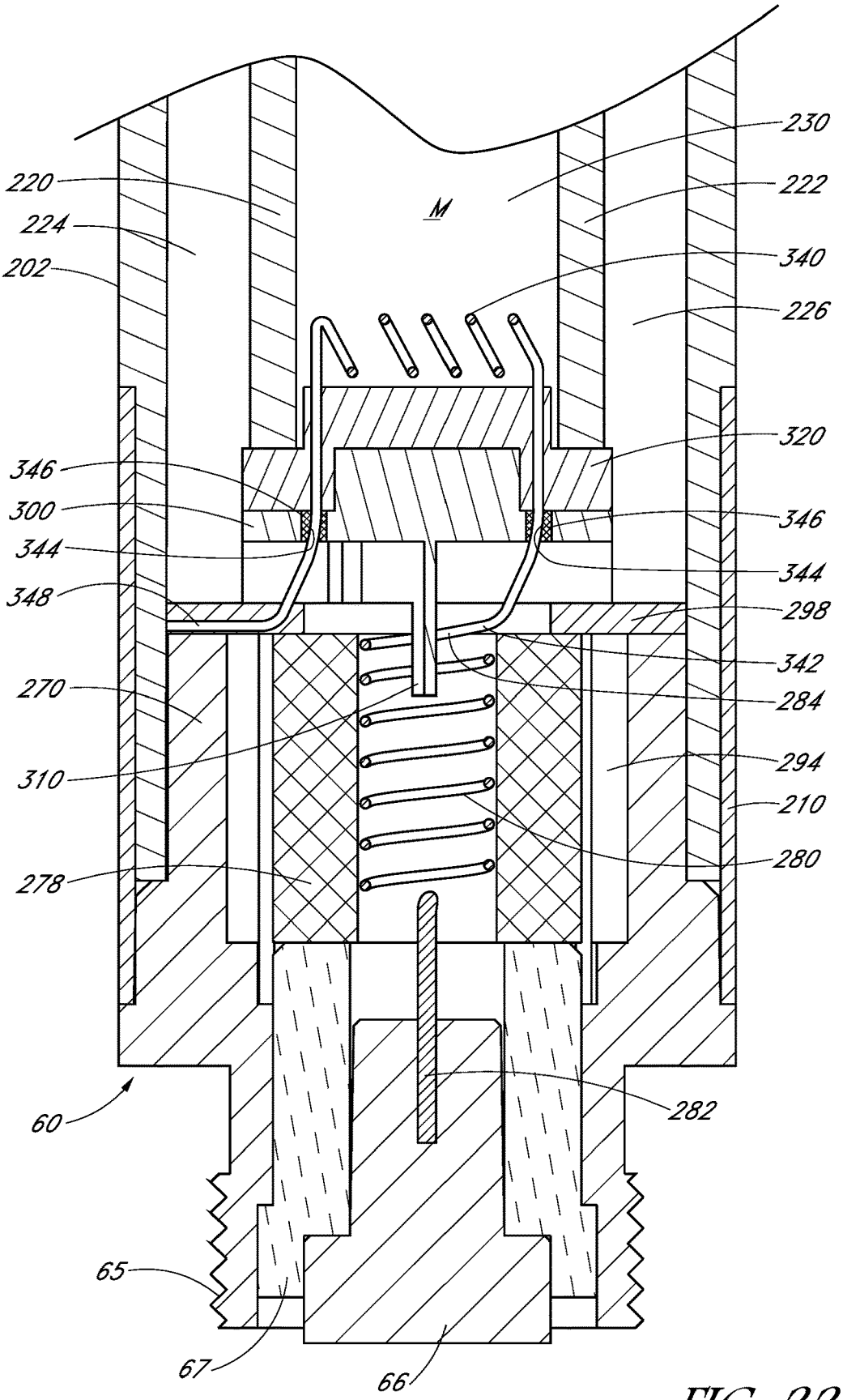
FIG. 22 shows yet another embodiment of a personal vaporizer, and the view is similar to the view of FIG. 15.

With reference next to FIG. 22, in an additional embodiment, a secondary heating element 340, such as a secondary wire coil, can be arranged electrically in series with the heating coil 280. In the illustrated embodiment, the second end 284 of the heating coil 280 is attached to a first end 342 of the secondary heating wire 340. The first end 342 of the secondary heating wire 340 extends through passages 344 (and, if necessary, insulators 346) in the guide member 300 and tank seal 320 to the secondary coil 340, which is disposed within the distal portion of the tank 230. A second end 348 of the secondary coil 340 also extends through a passage 344 through the tank seal 320 and guide member 300 and is wedged between the spacer 298 and base 60 so that the second end 348 is in electrical communication with the base 60. Of course, other specific configurations can be employed in yet additional embodiments. Preferably the secondary coil 340 is selected and configured to generate substantially less heat than the heating coil 280, so as to warm, rather than atomize, media within the distal portion of the tank 230. In some embodiments, electrical components, such as a resistor, can be interposed between the heating coil 280 and the secondary heating coil 340.

Figure 23:
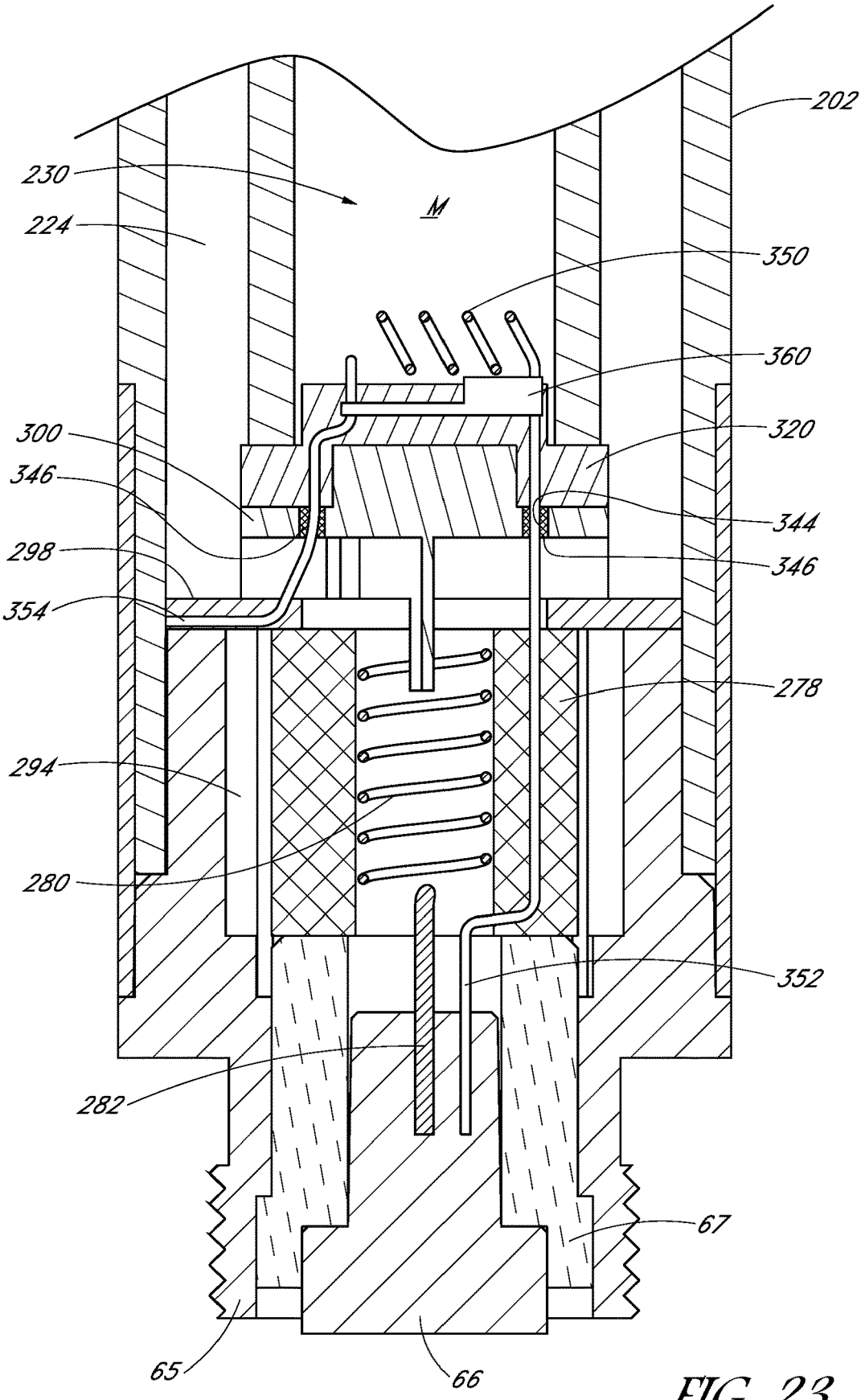
FIG. 23 shows still another embodiment of a personal vaporizer, and the view is similar to the view of FIG. 15.

With reference next to FIG. 23, in yet an additional embodiment, a secondary heating element 350, here a secondary heating coil, is arranged electrically in parallel with the heating coil 280. As shown, a first secondary supply wire 352 can be attached to the connector pin 66, and can extend proximally, such as through passages 344 (and, if necessary, insulator sleeves 346) through the wick 278, guide member 300 and tank seal 320, to the secondary coil 350 in the distal portion of the tank 230. A second secondary supply wire 354 can be directed into contact with the base 60 to complete the circuit.

In the illustrated embodiment, an electricity conditioning apparatus 360 is provided in the circuit having the secondary heating wire 350. The illustrated conditioning apparatus 360 is disposed in the tank seal 320, but can be positioned elsewhere in the vaporizer as desired. Also, the illustrated embodiment depicts the conditioning apparatus 360 schematically, with the first secondary supply wire 352 leading to the conditioning apparatus 360, the secondary coil 350 extending from the conditioning apparatus 360, and the second secondary wire 354 also extending from the conditioning apparatus 260. It is to be understood that the conditioning apparatus 260 can include a complex printed circuit board having multiple electrical components and/or processing capability, or can comprise something as simple as a single resistor interposed along the first secondary supply wire 352.

Preferably, the conditioning apparatus 360 is configured to condition electric power being supplied to the secondary coil 350 so that an appropriate amount of electricity is provided to the secondary coil 350. For example, the conditioning apparatus 360 may comprise one or more resistors configured to reduce current flow through the secondary coil 350. In other embodiments, the conditioning apparatus 360 can employ duty cycle control of the electric power to regulate heat generated by the secondary coil 350. In still further embodiments, the conditioning apparatus 360 can include a sensor adapted to monitor the temperature of the vaporizing media M in the tank 230, and other components of the conditioning apparatus 360 will condition the power supply so as to maintain the media temperature within a desired range. In still further embodiments, the conditioning apparatus 360 is configured to receive signals via the connector pin 66 and first wire end 352. Such signals may direct the conditioning apparatus to control the secondary coil 350 according to one or more control strategies saved in the conditioning apparatus 360.

Of course, it is to be understood that various specific structures can be employed to pre-warm media M in the tank, and that such strategies can employ one or more of various types of heating elements positioned in various locations (such as upon the tank wall(s), within the media channels, or the like). Such strategies may further, or instead, employ various specific structures for communicating a portion of the heat generated by the heating coil to the vaporizing media M.

It is also to be understood that, in additional embodiments, the specific shape of the center section can be modified as desired, and the configuration of the inlet and outlet passages can also be somewhat different. For example, in some embodiments the outlet passage can have a greater cross-sectional area than the inlet passage, and similarly with the inlet side of the air guide versus the outlet side of the air guide. Further, in some embodiments, the inlet passage can be configured to extend distally past the wick so that intake air is provided downstream of the wick, and flows proximally through the vaporization chamber. In some such embodiments the inlet passage may be configured so that air in the inlet passage contacts a portion of the outer surface of the wick, so that some atomized media may be entrained in such air A. Such air will then be directed through the vaporization chamber, in which additional atomized media will be entrained in the air A.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A personal vaporizer having a distal end and a proximal end, comprising:

a mouthpiece at the proximal end of the personal vaporizer;

a center section distal of the mouthpiece, the center section having a longitudinal axis and comprising an elongated inlet passage, an elongated outlet passage, and a tank, the elongated inlet passage and elongated outlet passage being on opposite sides of the longitudinal axis, the tank being sandwiched between the inlet and outlet passage, an inlet formed through a wall of the center section proximal of a distal end of the tank, the inlet communicating with the inlet passage, the inlet passage extending distally from the inlet, the outlet passage communicating with the mouthpiece that is proximal of the tank;

a vaporization chamber defined distal of the tank, the vaporization chamber comprising a wick and a heating element, the wick being in communication with the tank so that vaporizing media from the tank flows into the wick, the heating element configured to atomize vaporizing media from the wick when the heating element is actuated;

the inlet passage configured to direct intake air distally to a distal end of the inlet passage that is upstream of the vaporization chamber; and a distal end of the outlet passage configured to receive vapor from the vaporization chamber, the outlet passage extending proximally from the distal end of the outlet passage to the mouthpiece.

2. The personal vaporizer of claim 1, wherein a fill hole is formed through a proximal wall of the tank, and wherein the mouthpiece comprises a stopper that is integrated with the mouthpiece so as to move with the mouthpiece, the stopper being configured to plug the fill hole when the mouthpiece is attached to a proximal end of the center section, the mouthpiece additionally comprising a mouthpiece passage having an outlet, and wherein when the mouthpiece is attached to the proximal end of the center section, the outlet passage communicates with the mouthpiece passage.

3. The personal vaporizer of claim 1, wherein the heating element is positioned along the longitudinal axis of the center section.

4. The personal vaporizer of claim 3, wherein the heating element comprises a coil coiled about a coil axis, and the coil axis is aligned with the longitudinal axis of the center section.

5. The personal vaporizer of claim 4, wherein the outlet passage is diametrically opposite the inlet, and the tank is between the inlet and the outlet passage.

6. The personal vaporizer of claim 1, additionally comprising a battery mount extending distally from the center section, the battery mount disposed distal of the vaporization chamber.

7. The personal vaporizer of claim 1, wherein the distal end of the inlet passage opens into an inlet space that is distal of the tank and proximal of the vaporization chamber, the inlet space configured to direct intake air from the distal end of the inlet passage radially inwardly.

8. The personal vaporizer of claim 7, wherein an air guide extends distally through the inlet space and through a proximal opening of the vaporization chamber, and the air guide is configured to redirect intake air moving radially through the inlet space distally and into the vaporization chamber.

9. The personal vaporizer of claim 8, wherein an inlet side of the air guide faces the distal end of the inlet passage, and an outlet side of the air guide faces the distal end of the outlet passage.

10. A personal vaporizer, comprising:

a tank configured to contain a vaporizing medium;

a vaporization chamber;

a media channel interposed between the tank and the vaporization chamber and configured to receive vaporizing medium from the tank, a cross-sectional area of an upstream opening of the media channel being substantially less than a cross-sectional area of the tank;

a wick configured to communicate vaporizing medium from the media channel to the vaporization chamber;

a power source comprising a positive electrical pole and a negative electrical pole;

a heating element at or adjacent the vaporization chamber, the heating element configured to atomize vaporizing medium within the vaporization chamber when the primary heating element is actuated, the primary heating element interposed in a first electrical circuit between the positive and negative electrical pole; and a secondary powered element spaced from the heating element and spaced from the wick and disposed within the tank upstream opening of the media channel, the secondary powered element interposed in a second electrical circuit between the positive and negative electrical pole;

wherein the first electrical circuit is configured to supply power to the heating element but not to the secondary powered element, and the second electrical circuit is configured to supply power to the secondary powered element but not the heating element.

11. The personal vaporizer of claim 10, wherein the secondary powered element comprises a second heating element that is spaced from the wick, and wherein the second heating element is configured to not generate sufficient heat to atomize vaporization medium.

12. The personal vaporizer of claim 11 additionally comprising a secondary controller configured to control power delivery to the second heating element independent of the heating element.

13. The personal vaporizer of claim 12 additionally comprising a sensor configured to detect a sensed condition of vaporizing medium in the tank, the sensor further configured to communicate the sensed condition to the secondary controller, and the secondary controller being configured to control power delivery to the second heating element depending at least partially on the sensed condition.

14. The personal vaporizer of claim 12 additionally comprising a sensor configured to detect a sensed condition of vaporizing medium in the tank, the sensor further configured to communicate the sensed condition to the controller, and the controller being configured to control power delivery to the secondary powered element depending at least partially on the sensed condition.

15. The personal vaporizer of claim 10 additionally comprising a controller configured to control power delivery to both the heating element and the secondary powered element, and wherein a different amount of power is delivered to the secondary powered element than is delivered to the heating element.

16. The personal vaporizer of claim 10, wherein the tank has a first cross-sectional area and the media channel has a second cross-sectional area, and the first cross-sectional area is greater than the second cross-sectional area.

17. The personal vaporizer of claim 10, wherein no portion of the wick extends through the media passage into the tank.

* * * * *